US006164170A

United States Patent [19]

Habermehl et al.

[11] Patent Number: 6,164,170

[45] Date of Patent: Dec. 26, 2000

[54] SEMI-AUTOMATIC SCREWDRIVER FOR COLLATED SCREWS

[76] Inventors: G. Lyle Habermehl, 436 Calvert Dr., Gallatin, Tenn. 37066; Paul Townsend Scherer, 4245 Bridgemont La., Lexington, Ky. 40514

[21] Appl. No.: 09/453,004

[22] Filed: Dec. 2, 1999

[51] Int. Cl.[7] ..... B25B 23/04

[52] U.S. Cl. ..... 81/434; 81/57.37

[58] Field of Search ..... 81/57.37, 434

[56] References Cited

U.S. PATENT DOCUMENTS

| | | | |
|---|---|---|---|
| 1,815,594 | 7/1931 | Shaw et al. . | |
| 3,891,014 | 6/1975 | Gunn | 144/32 |
| 4,146,071 | 3/1979 | Mueller | 144/32 |
| 4,998,452 | 3/1991 | Blum | 81/57.37 |
| 5,231,900 | 8/1993 | Deri | 81/57.37 |
| 5,341,706 | 8/1994 | Takagi | 81/434 |
| 5,568,753 | 10/1996 | Habermehl et al. | 81/434 |
| 5,570,618 | 11/1996 | Habermehl et al. | 81/434 |
| 5,584,221 | 12/1996 | Petrantoni | 81/434 |
| 5,660,090 | 8/1997 | Deri | 81/434 |
| 5,699,704 | 12/1997 | Habermehl | 81/434 |
| 5,870,933 | 2/1999 | Habermehl et al. | 81/434 |
| 5,927,163 | 7/1999 | Habermehl et al. | 81/434 |
| 5,934,162 | 8/1999 | Habermehl | 81/434 |

*Primary Examiner*—James G. Smith
*Assistant Examiner*—David B. Thomas
*Attorney, Agent, or Firm*—Dorsey & Whitney LLP

[57] ABSTRACT

A screwdriver tool attachment which provides a channel for advance of a screwstrip via a reciprocating pawl which is reciprocally movable by a lever arm adapted for manual engagement to either move the pawl to an advanced or a withdrawn position.

20 Claims, 15 Drawing Sheets

52
30
32
11
121
34
270
272
274
38
79
22
18
19
122
81
94
88
16
13
78
24
86
13'
87
125
82
83
84
52
14
124

SEMI-AUTOMATIC SCREWDRIVER FOR COLLATED SCREWS

SCOPE OF THE INVENTION

This application relates generally to a screwdriver for driving collated screws which are joined together in a strip and, more particularly, to a tool which permits manual advance of screws in a screwstrip for driving with a screwdriver, preferably, a power screwdriver.

BACKGROUND OF THE INVENTION

Screwstrips are known whereby the screws are connected to each other by a retaining belt preferably of plastic material. Screws in such strips are engaged by a bit of a screwdriver and then screwed into a workpiece. In the course of the bit engaging the screw and/or driving the same into the workpiece, the screw becomes attached from the plastic strip.

Known screwstrips of this type are disclosed in Canadian Patent 1,040,600, issued Oct. 17, 1978 to Schwartz; U.S. Pat. No. 4,167,229 to Keusch et al, issued Sep. 11, 1979; U.S. Pat. No. 4,930,630 to Habermehl, issued Jun. 5, 1990; U.S. Pat. No. 5,758,768 to Habermehl, issued Jun. 2, 1998 and U.S. Pat. No. 5,819,609 to Habermehl, issued Oct. 13, 1998, the disclosures of which are incorporated herein by reference.

Screws carried by such strips are adapted to be successively incrementally advanced to a position in alignment with and to be engaged by a bit of a reciprocating, rotating power screwdriver and screwed into a workpiece. In the course of the bit engaging the screw and driving it into a workpiece, the screw becomes detached from the plastic strip leaving the strip as a continuous length.

In the use of such collated screwstrips in screwdrivers, the strip serves a function of assisting in guiding the screw into a workpiece and to accomplish this, the strip is preferably retained against movement towards the workpiece. In the strip, each screw to be driven has its threaded shaft preferably threadably engaged in a threaded sleeve of the strip such that on the screwdriver engaging and rotating each successive screw, the screw turns within the sleeve which acts to guide the screw as it moves forwardly into threaded engagement into the workpiece. Preferably, only after the tip of the screw becomes engaged in the workpiece, does the head of the screw come into contact with the sleeve. Further forward movement of the screw into the workpiece then draws the head downwardly to engage the sleeve and rupture the sleeve by reason of the forward movement of the head with the strip retained against movement towards the workpiece. The sleeve is preferably configured to have fragible straps which break on the head passing through the sleeve such that the strip remains intact as a continuous length. Since the strip is a continuous length, on advancing the strip with each successive screw to be driven, it necessarily results that portions of the strip from which each screw has been driven are also advanced to exit from the power screwdriver.

Known power screwdrivers for driving said collated screwstrips include U.S. Pat. No. 4,146,071 to Mueller, issued Mar. 27, 1996; U.S. Pat. No. 5,568,753 to Habermehl, issued Oct. 29, 1996; U.S. Pat. No. 5,870,933 to Habermehl, issued Feb. 16, 1999 and U.S. Pat. No. 5,570,618 to Habermehl et al., issued Nov. 5, 1996.

Each of these patents teach an automatic feed screwdriver in which a housing is fixably secured to a power screwdriver.

A slide body is provided reciprocally slidable relative the housing and an extension spring is provided so as to bias the slide body outwardly relative the housing. The slide body carries a screw feed channel to receive the screwstrips and via which the screws held in the screwstrips are advanced radially to a point where each successive screw to be driven is coaxially arranged within a bore of a guide tube coaxially in line with a driver shaft. These prior art auto feed screwdrivers provide for various linkages between the slide body and the housing such that on reciprocal telescopic sliding of the slide body into and out of the housing between extended and retracted positions, the linkages cause automatic advance of the screwstrip in the feed guide channel. The relative timing of the advance of the screwstrip is thereby timed and linked to the relative position of the slide body in the housing in a complete cycle of movement from an extracted position to a retracted position and back to the extended position.

These prior art devices have the disadvantage that they must provide both a housing and a slide body and for an appropriate linkage between the two in order for automatic advance of the screwstrip in a desired manner.

Such known auto feed screwdriving tools have the disadvantage that they require relatively large number of parts, that they require a housing which is adapted to be physically coupled to the power driver tool, that they require a mechanism for linking of the slide body to the housing, that they require an extension spring which typically needs to be relatively substantial to bias the slide body to an extended position out of the housing, that on using a device, a user must, to drive a screw, overcome the relatively substantial forces of the extension spring biasing the slide body to the extended position out of the housing and that the forces which are applied to advance the screwstrip are frequently limited either to springs provided in the devices for such purpose or to levered forces which can be developed by the linkages between the slide body and the housing.

These previously known auto feed devices suffer the disadvantage of being relatively complex, expensive and not readily adapted for the production as an inexpensive consumer tool.

SUMMARY OF THE INVENTION

To at least partially overcome these disadvantages of the prior art, the present invention provides a semiautomatic screwdriver tool adapted for manual advance of screws in a screwstrip by a user. The present invention preferably provides a screwdriver tool attachment which provides a channel for advance of a screwstrip via a reciprocating pawl which is reciprocally movable by a lever arm adapted for manual engagement to either move the pawl to an advanced or a withdrawn position. Preferably, the manual engagement provides forces to advance the screwstrip and load a spring which will return the lever and its pawl to a withdrawn position ready to advance the next screw in the screwstrip to be driven.

An object of the present invention is to provide a simplified tool for advancing and driving screws in collated screwstrips.

Another object is to provide an inexpensive semiautomatic tool for driving collated screws.

According to one aspect, the present invention provides an apparatus for driving with a power driver a screwstrip comprising threaded fasteners, such as screws or the like, which are joined together in a strip comprising:

an elongated driver shaft having a rear end for operative connection to a power driver for rotation therewith and a forward end carrying a fastener engaging member, the driver shaft defining a longitudinal axis;

a slide body about the driver shaft for displacement parallel to the axis of the driver shaft, the slide body having a guide channel for said screwstrip transverse to the axis, a pawl member carried by the slide body movable relative to slide body transverse to the axis towards and away from the axis between an advanced position and a withdrawn position, the advanced position being closer to the axis than the withdrawn position, the pawl member adapted for engagement with the screwstrip to advance the screwstrip in the guide channel with movement of the pawl member towards the axis to the advanced position to place each successive first of the fasteners into axial alignment with the driver shaft for driving by the driver shaft, the pawl member adapted for movement away from the axis to the withdrawn position ready for subsequent movement toward the axis to advance a next successive first of the fasteners, a lever having a first end, the lever pivotally mounted to the slide body remote from the first end of the lever;

the first end of the lever coupled to the pawl member whereby movement of the second end of the lever in a first direction moves the pawl member towards the advanced position and movement of the second end of the lever in a second direction opposite the first moves the pawl member toward the withdrawn position;

the slide body having a handle portion adapted for manual grasping for a hand of a user;

a lever activation member coupled to the lever whereby movement of the lever activation member pivots the lever, the lever activation member disposed proximate the handle portion adapted for releasable engagement by a user's hand grasping the handle to pivot the lever in at least one of the first direction and the second direction.

DESCRIPTION OF THE DRAWINGS

Further aspects and advantages of the present invention will appear from the following description taken together in the accompanying drawings in which.

DETAILED DESCRIPTION OF THE DRAWINGS

Figure 1:
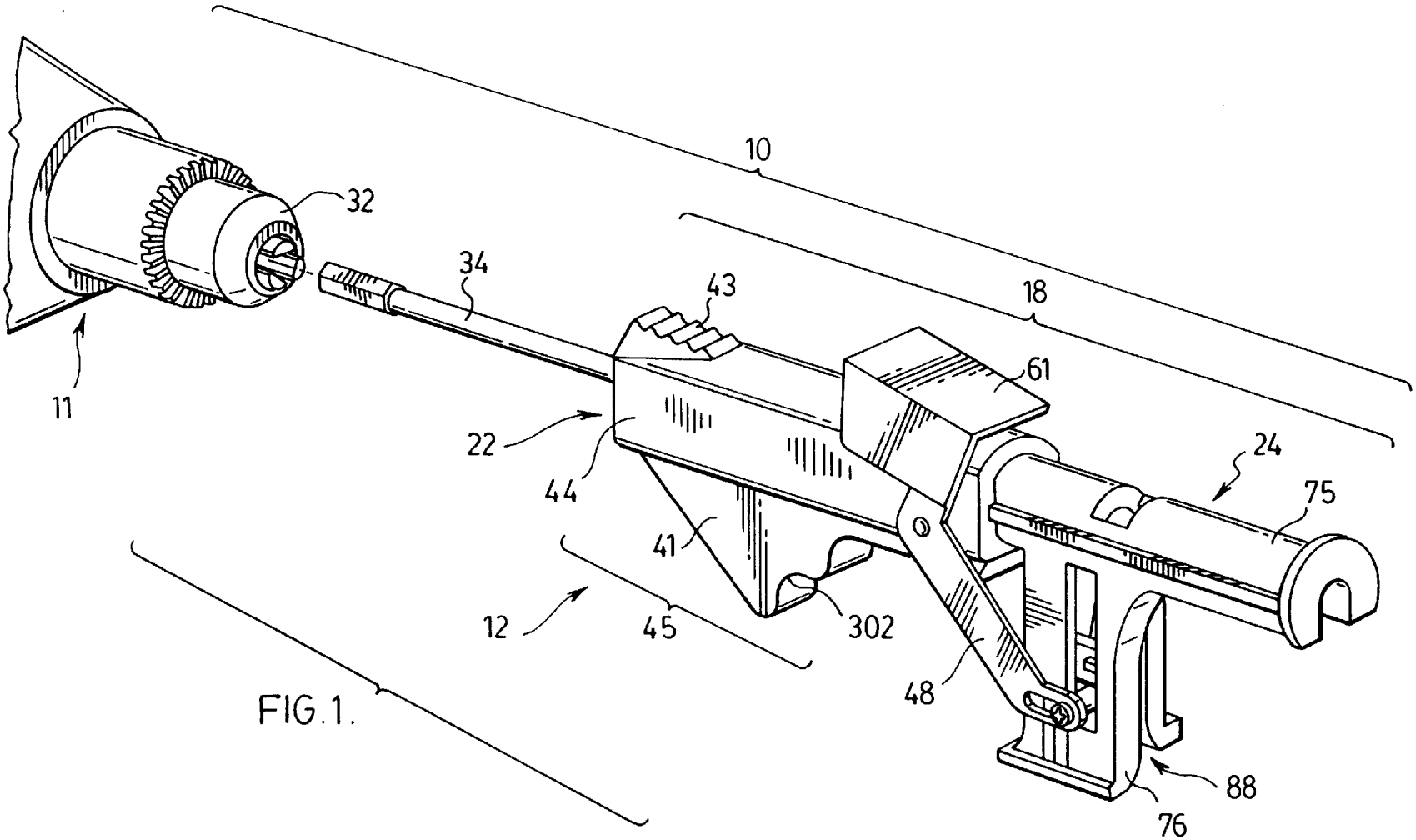
FIG. 1 is a pictorial view of a screwdriver feed tool in accordance with a first embodiment of the present invention shown with the front end of a power driver.
Figure 2:
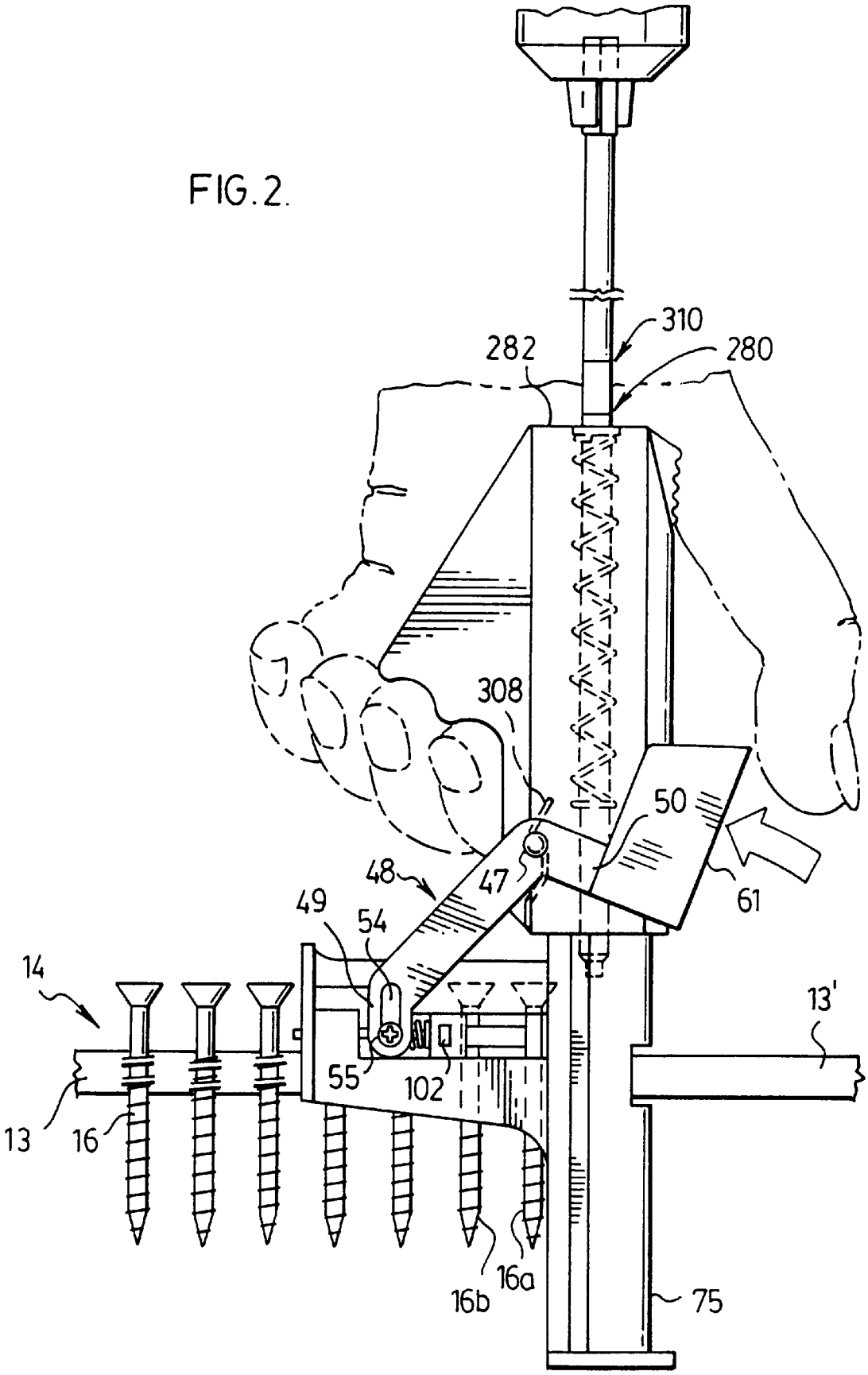
FIG. 2 is a side view of the screwdriver feed tool of FIG. 1 after a screw has been driven and ready for advance of the next screw.
Figure 3:
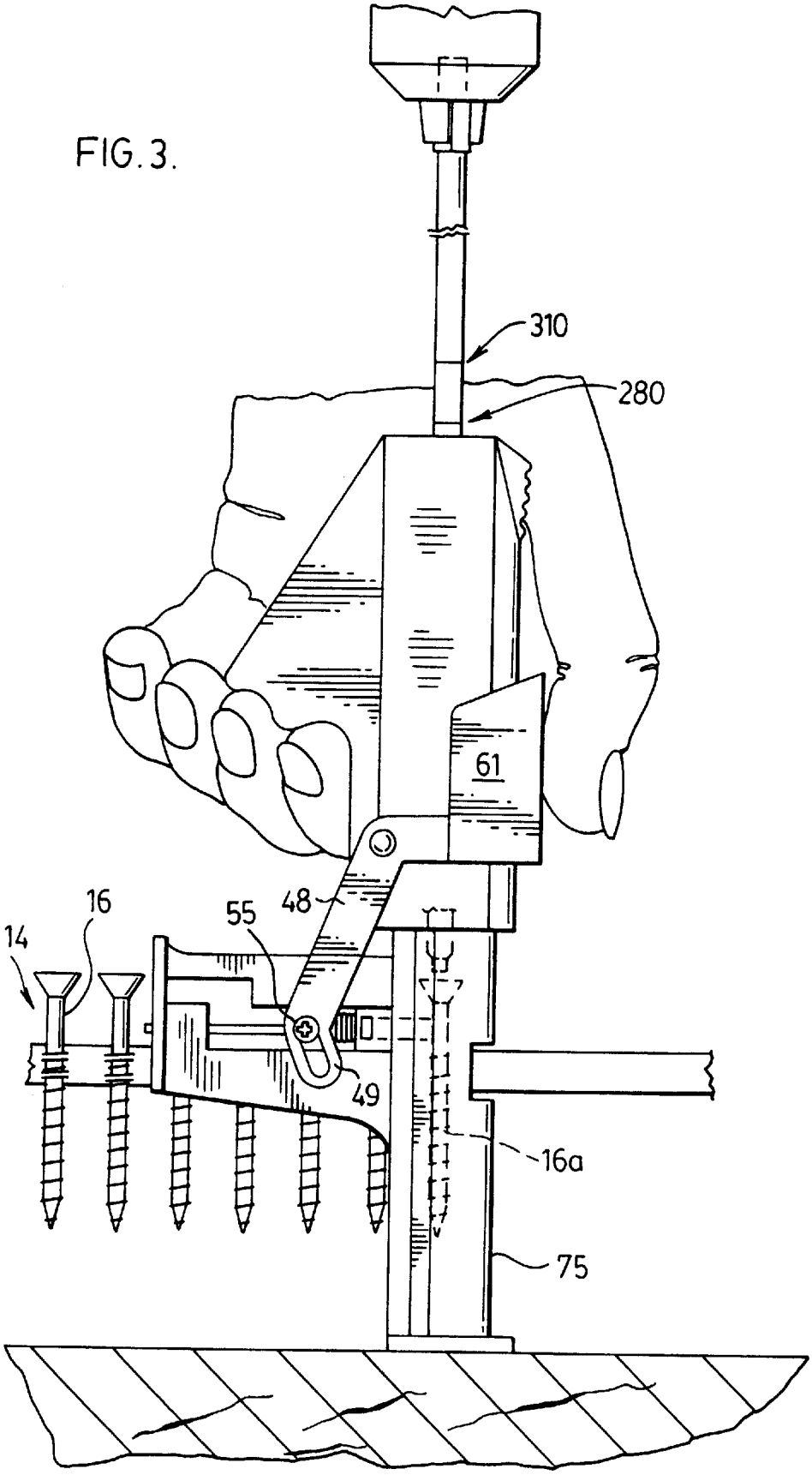
FIG. 3 is a side view similar to that of FIG. 2 however, after the screwstrip has been manually advanced and with the power driver moved forwardly to engage the next screw to be driven.
Figure 4:
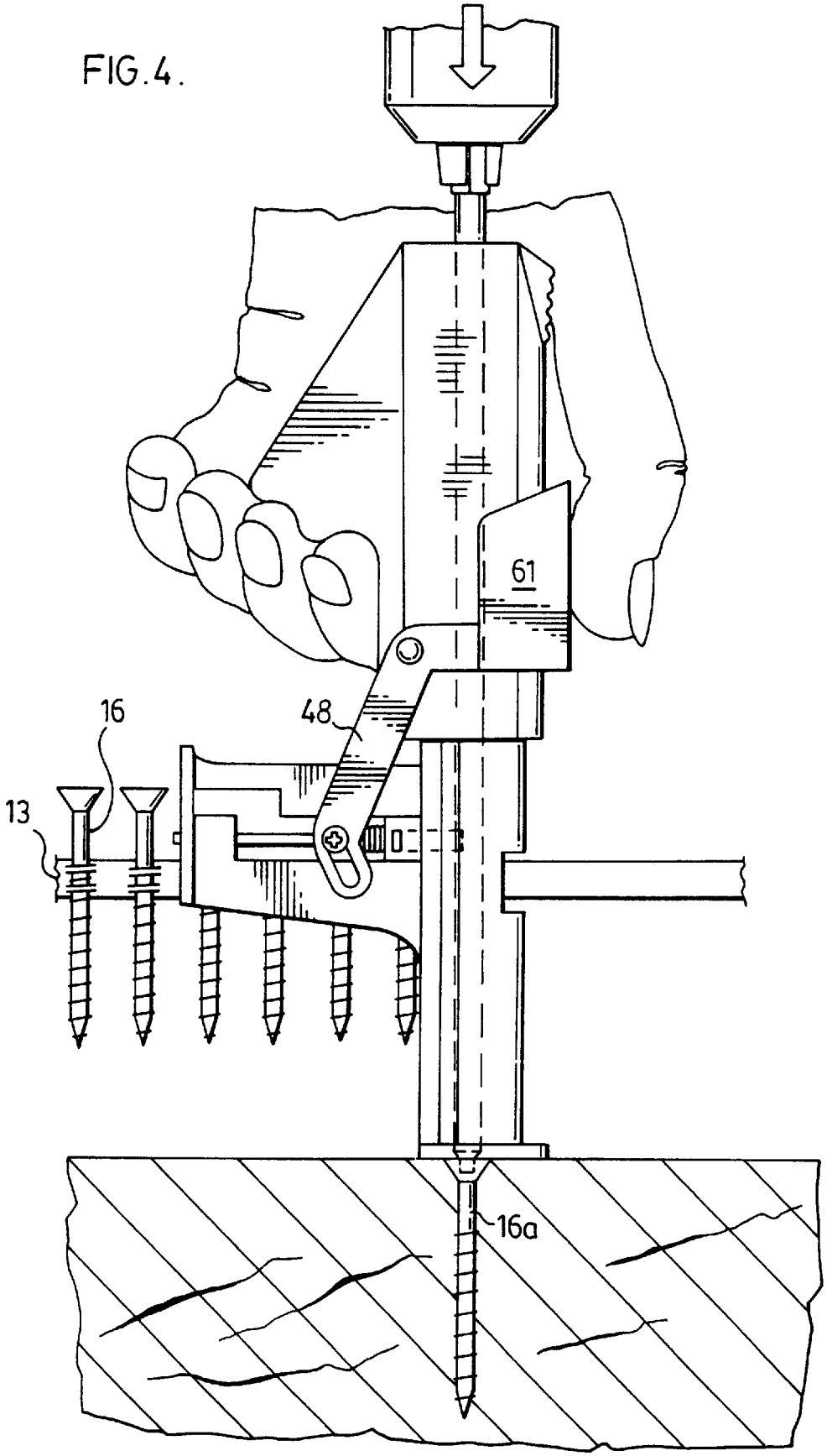
FIG. 4 is a side view similar to that of FIGS. 2 and 3, however, showing a screw having been driven fully into a workpiece.

Reference is made to FIG. 1 which shows an exploded view of a power screwdriver assembly 10 in accordance with the present invention. The assembly 10 includes a power driver 11 and a screwdriver feed tool 12. As seen in FIGS. 2 to 4, the feed tool 12 is adapted to receive a collated screwstrip 14 carrying spaced screws 16 to be successively driven.

Figure 8:
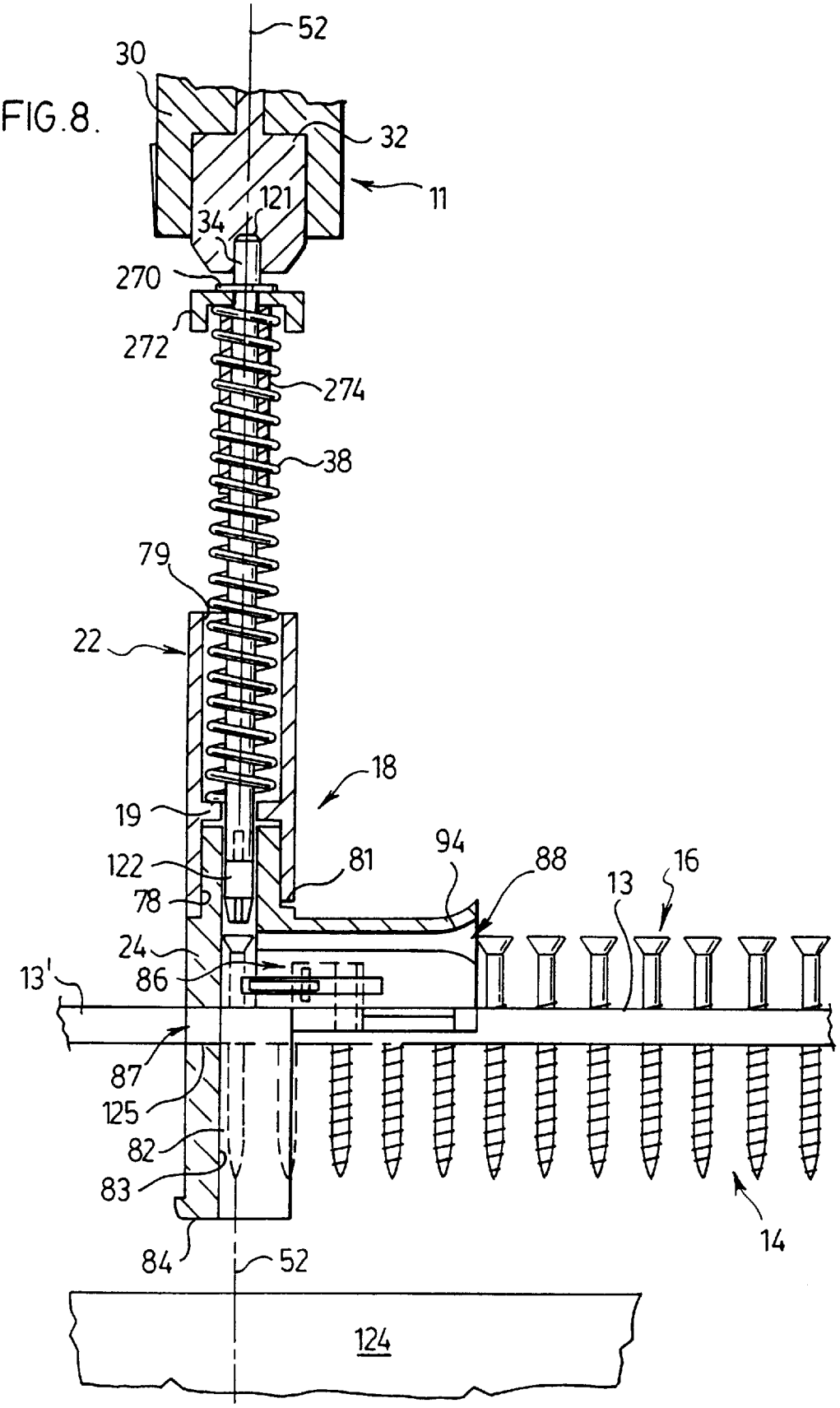
FIG. 8 is a cross-sectional reverse side view of the screwdriver feed tool of FIG. 1 in a position similar to that shown in FIG. 2.
Figure 9:
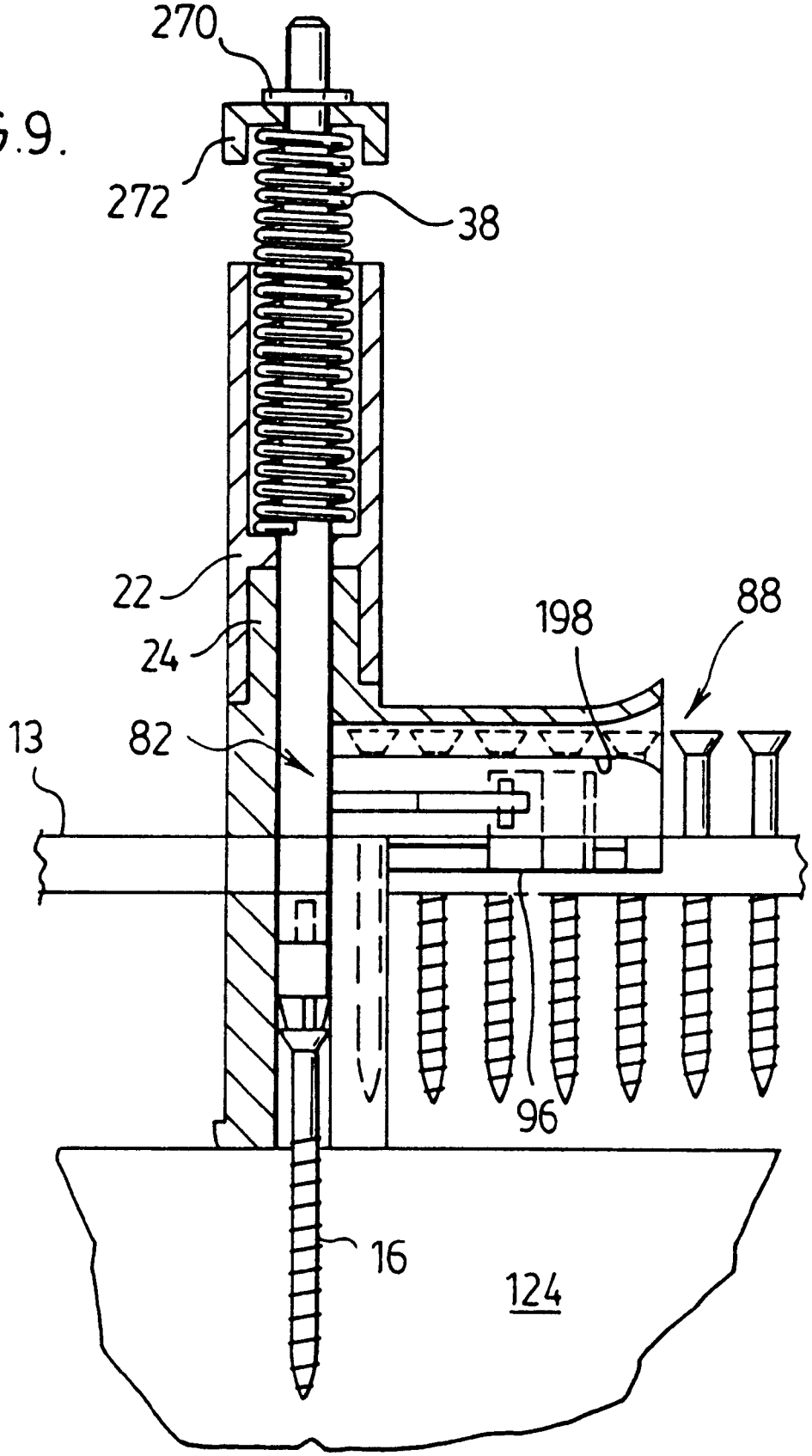
FIG. 9 is a cross-sectional reverse side view of the screwdriver feed tool shown in FIG. 8, however, in a position intermediate to that shown in FIGS. 3 and 4.

The major components of the feed tool 12 include a slide body 18 comprising a rear portion 22 and a removable nose portion 24. FIGS. 8 and 9 best show in cross-section the interaction of these components.

The power driver 11 has chuck 32 rotatable in a chuck housing 30 as by an electric motor not shown. The chuck 32 releasably engages the driver shaft 34 in a known manner.

As seen in FIG. 1, the rear portion 22 of the slide body 18 comprises a tubular element 44 which carries a handle portion 45 having a digit grip portion 41 and a thumb grip 43 portion thereon. The rear portion 22 is removably secured to the nose portion 24.

The nose portion 24 includes a guide tube 75 and a feed channel element 76 extending radially from the guide tube 75. The feed channel element 76 has a channelway 88 to receive a screwstrip and via which screws of the screwstrip are advanced into the guide tube 75 for driving successively by the driver shaft 34.

Figure 5:
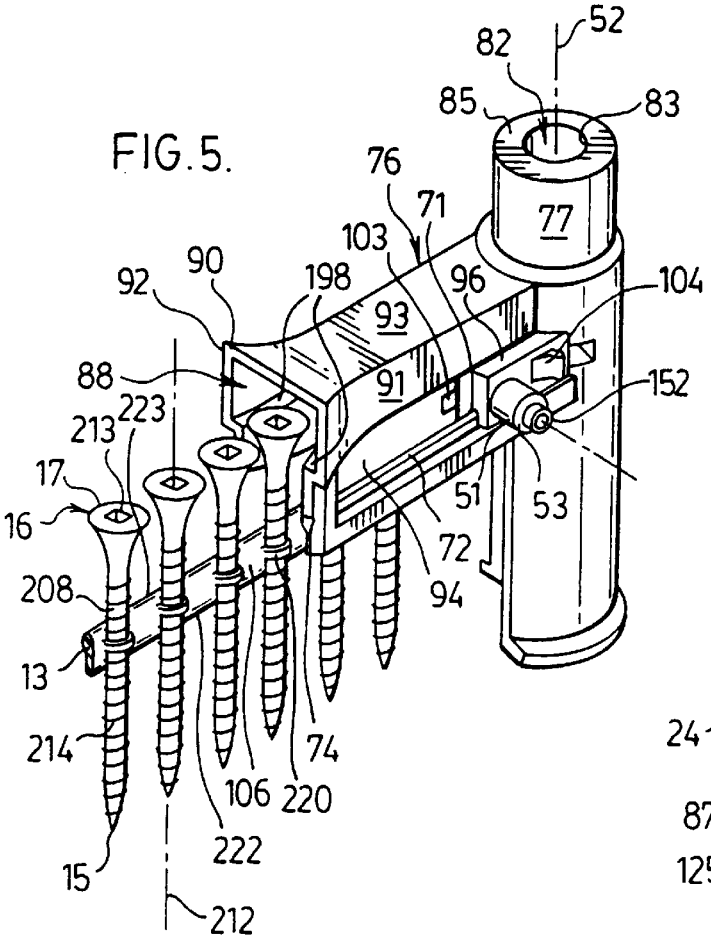
FIG. 5 is a pictorial view of a nose portion of the screwdriver feed tool shown in FIG. 1 having a screwstrip received therein.

As seen in FIG. 5, a shuttle 96 is slidably mounted on the feed channel element 76 for sliding in a raceway 94 transverse to the axis 52 of the drive shaft 34 towards and away from axis 52 centered in the guide tube 75. The shuttle 96 carries a pawl 99, best seen in FIG. 7 to engage the screwstrip and to advance the screwstrip when the shuttle 96 moves toward the axis 52 in the guide tube 75.

A lever 48, best seen in FIG. 2, has a first end 49 coupled to the shuttle 96 and a second end 50 which carries an activation plate 61. The lever is pivotally mounted between the first and second ends on a pivot axle 47. Shuttle 96 carries a shuttle mount post 51 having a reduced diameter pivot pin 152 at its end and presenting a shoulder surface 53.

Lever 48 has a lost link motion slot 54 at its first end sized to journal and slide on pin 52. A screw 55, preferably carrying a washer, secures the first end 49 of the lever 48 to the post 51 for pivoting and sliding on pin 52 with a rear surface of the lever 48 supported on the shoulder surface 53.

The lost motion slot 54 has semicircular ends. The lost motion slot 54 is sized to receive the shuttle mount pin 152 therein, permitting relative sliding along the length of the slot and relative pivoting about the axis of the pin 152 when the pin is in any location in the slot.

The guide tube 75 is arranged generally coaxially about longitudinal axis 52. As seen in FIG. 5, the guide tube 75 has a cylindrical portion 77 at its rear end with a cylindrical exterior sized to be closely received, preferably in a friction fit, within a forwardly opening cylindrical bore 78 in a forward end of the rear portion 22 as shown in FIG. 8. A radially extending key 80, shown in FIG. 6, is provided to extend from the cylindrical portion 77 of the nose portion 24 to be received in a correspondingly sized key way slot 81 in the rear portion 22 as best seen in FIG. 8 to secure the nose portion 24 to the rear portion 22 against relative pivoting about the longitudinal axis 52.

Figure 6:
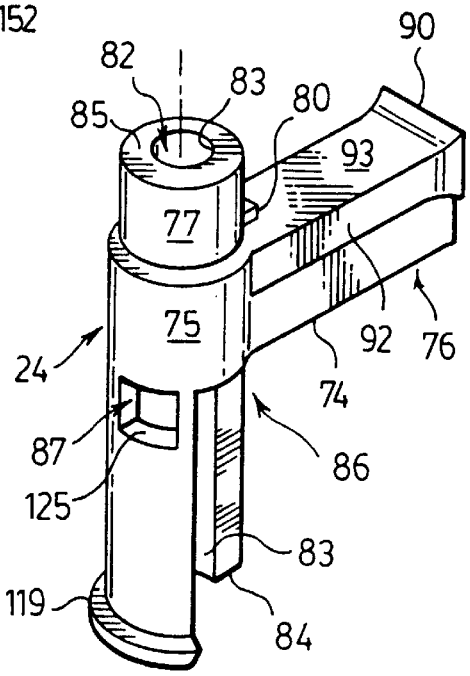
FIG. 6 is a pictorial view of the nose portion shown in FIG. 5, however, from the other side thereof.

As seen in FIGS. 8 and 9, the guide tube 75 has a cylindrical bore or guideway 82 extending axially through the guide tube with the guideway 82 delineated and bordered by a radially extending cylindrical side wall 83 open at its forward axial end 84 and its rear axial end 85 as seen in FIG. 6.

The guide tube 75 has a rearward section adjacent its rear end 85 in which the side wall extends 360 degrees about the guideway 82. Forward of the rearward section, the guide tube has a forward section best seen in FIGS. 6 and 8 which has an access opening 86 on one right side of the guide tube 75. Screw access opening 86 is provided to permit the screwstrip 14 including retaining strip 13 and screws 16 to move radially inwardly into the guideway 82 from the left as seen in FIGS. 2 to 5. As seen in FIG. 5, each screw 16 preferably has a head 17 with a diameter marginally smaller than the diameter of the side wall 83. It follows that where the head of the screw is to enter the guideway 82, the screw access opening must have a circumferential extent of at least a 180 degrees. Where a shank 208 of the screw is to enter the guideway, the screw access opening may have a lesser circumferential extent.

In the forward section, the side wall 83 of the guide tube 75 engages the radially outer most periphery of the head 17 of the screw 16, to axially locate the screw head 17 coaxially within the guideway 82 in axial alignment with the driver shaft 34. In this regard, the side wall 83 preferably extends about the screw sufficiently to coaxially locate the screw head and thus preferably extend about the screw head at least 120 degrees, more preferably at least 150 degrees and more preferably about 180 degrees.

An exit opening 87, shown towards the left hand side of the guide tube 75 in FIG. 6 is provided of a size to permit the spent plastic strip 13' from which the screws 16 have been driven to exit from the guideway 82 as shown in FIG. 8. The exit opening 87 is shown as an opening bordered on its front, rear and two sides to assist in retaining the spent strip 13' in the exit opening. Forwardly of the exit opening 87, the side wall 83 is shown as extending about 180 degrees about the longitudinal axis 52 so as to continue to provide a side wall 83 which can assist and positively coaxially guide the head 17 of a screw 16 being driven.

The screw feed channel element 76 is best seen in FIGS. 5 and 6 as providing a channelway 88 which extends radially relative the longitudinal axis 52 to intersect with the guideway 82 in the guide tube 75. In this regard, the channelway 88 opens to the guideway 82 as the screw access opening 86. The channelway 88 provides a channel of a cross-section similar to that of the screw access opening 86 from the screw access opening 86 to a remote entranceway 90. The channelway 88 is defined between two side walls 91 and 92 joined by a top wall 93. The major side wall 91 is shown as extending from the head 17 of the screws 16 forwardly to at least partially beside the plastic retaining strip 13. The lesser side wall 92 is shown as extending from the head 17 of screws 16 forwardly to above the plastic strip 13. Stopping the lesser side wall from extending down over the strip 13 assists in reducing friction between the strip 13 and the lesser side wall. The side walls 91 and 92 define the channelway 88 with their cross-section confirming closely to that of the screwstrip 14 and its strip 13 and screws 16. Their cross-sectional has an enlarged width where the heads of the screw are located and an enlarged width where the retaining strip is provided about the screws. The side walls 91 and 92 also have an enlarged funneling section at the entranceway opening 90 which tapers inwardly to assist in guiding the screwstrip to enter the channelway.

As best seen in FIG. 5, the major side wall 91 is provided on its exterior back surface with a raceway 94 extending parallel the channelway 88 and in which the shuttle 96 is captured to be slidable towards and away from the guide 75 between an advanced position near the guide tube and a withdrawn position remote from the guide tube.

The shuttle 96 has a bore guide 71 therethrough to be received about a guide pin 72 which has each of its ends secured in portions forming end walls of the raceway 94 such that the guide pin 72 positively retains and guides the shuttle 96 in the raceway 94.

Figure 7:
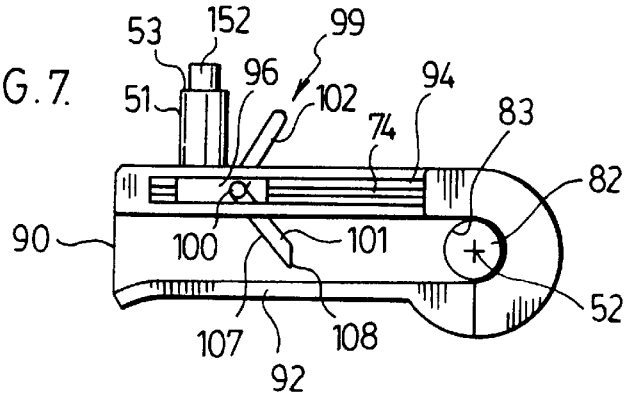
FIG. 7 is an end view of the nose portion of FIG. 6.

The shuttle 96 carries the pawl 99 to engage the screwstrip 14 and with movement with the shuttle 96 to successively advance the strip one screw at a time. As seen in FIG. 7, the shuttle 96 has a fixed post 100 on which the pawl 99 is journalled about an axis parallel the longitudinal axis 52 about which the driver shaft 34 rotates. The pawl 99 has a strip pusher arm 101 which extends through a slot 103 in the major side wall 91 to engage and advance the screwstrip. The pawl 99 has a manual release arm 102 away from pusher arm 101 and which extends out through a slot 104 in the shuttle 96. A torsional spring is disposed about post 100 between pawl 99 and shuttle 96 and urges the pusher arm 101 clockwise as seen in FIG. 7. The spring biases the pusher arm 101 into the screwstrip 14. The engagement of release arm 102 on the right hand end of slot 104 limits the pivoting of the pawl clockwise to the position shown in FIG. 7.

The pusher arm 101 of the pawl 99 has a cam face 107. On the shuttle moving away from the guide tube 75 towards the withdrawn position, i.e., to the left in FIG. 7, the cam face 107 will engage the screws 16 and/or the strip 13 and permit the pusher arm 101 to pivot about post 100 against the bias of the torsional spring so that the pusher arm 101 may move with the shuttle to the left.

The pusher arm 101 has an engagement face 108 to engage a screw 16 and/or strip 13. On the shuttle 96 moving towards the guide tube 75 towards the advanced position, i.e., to the right in FIG. 7, the engagement face 108 will engage a screw 16 and/or strip 13 and advance the screwstrip to the right as seen in FIG. 7 so as to position a screw 16 in the guideway 82 in a position to be driven and to hold the screwstrip 14 against movement towards the left. Preferably, as shown in FIG. 8, the engagement face 108 of the pusher arm engages the screw between its head 17 and the strip 13 as this has been found advantageous, particularly to avoid misfeeding with a nose portion 24 as shown with engagement of the screw heads in the channelway 88 and engagement of the spent strip 13' with the support surface 125.

The release arm 102 permits manual withdrawal of the screwstrip 14. A user may with his finger or thumb manually pivot the release arm 102 against the bias of the torsional spring so that the pusher arm 100 and its engagement face 108 is moved away from and clear of the screwstrip 14 whereby the screwstrip may manually be withdrawn as may be useful to clear jams and/or change screwstrips.

As seen in FIG. 2, when the assembly is in the fully extended position, the release arm 102 is accessible to one side of the lever 48.

The rear portion 22 comprises a handle portion 45 including a digit grip portion 41 and a thumb grip 43 provided so as to facilitate the grasping of the slide body 18 by one hand of a user as illustrated in FIGS. 2 to 4.

The digit grip portion 41 of the handle portion 45 extends radially from the rear portion 22 and, preferably as shown, in the same radial direction as the feed channel element 76 with the digit grip portion 41 located rearward of the feed channel element 76. The digit grip portion 41 is preferably provided with grooves 302 for engagement by the fingers of a users hand as shown in FIGS. 1 to 4. On the side of the rear portion 22 opposite the digit grip portion 41 there is preferably provided a thumb grip 43 for engagement by the lower portion of the thumb proximate the palm of a user's hand. It is to be appreciated that with the rear portion 22 comfortably received against the palm of a user's hand, the fingers may engage the digit grip portion 41 and the thumb may engage the thumb grip 43. As well, it is to be appreciated that while the rear portion 22 is shown as being grasped by a left hand of a user, the tool is adapted as to be grasped in a mirror image fashion by the right hand of a user.

The second end 50 of the lever is provided with a contact plate providing a contact surface 61 adapted to be engaged by the forward most section of a user's thumb as illustrated in FIGS. 3 and 4. The relative location of the handle portion is such that the pressure plate 61 carried on the lever 48 is readily accessible to be engaged by a user's thumb when a user's hand grasps and engages the handle portion 45 in a manner as shown. A user may readily engage the pressure plate 61 to apply pressure to the pressure plate and urge it to rotate in one direction, counter-clockwise, as seen in FIGS. 3 and 4 or remove his thumb from the pressure plate 61 and have the thumb disposed disengaged from the pressure plate as seen in FIG. 2.

A return spring 308 is provided as schematically illustrated in FIG. 2 as a torsional spring around the pivot axle 47 for the lever 48 to bias the lever for rotation in a clock-wise direction as seen in FIGS. 2 to 4. Under the bias of the return spring 308, the lever 48 is biased to assume the withdrawn position in FIG. 2 and it is to be appreciated that on release by the thumb of the user, the return spring returns the lever 48 to the withdrawn position shown in FIG. 2.

Operation of the tool is now explained with particular reference to FIGS. 2 to 4 as well as FIGS. 8 and 9.

FIG. 2 shows the tool at the start of a cycle of operation after a preceding screw has been driven and with the driver shaft 34 withdrawn manually to a point in which the driver shaft 34 is rear of the heads of the screws in the screwstrip. Under the bias of the return spring 308, the lever 48 has been pivoted to the withdrawn position shown in FIG. 2 thus positioning the shuttle 96 to a withdrawn position in which the pawl 99 is to the left-hand side of the next screw 16*a* to be driven.

With the tool in the position shown in FIG. 2, the user's thumb is placed on the pressure plate 61 and on pivoting the lever 48 from the position shown FIG. 2 to the position shown in FIG. 3, the next screw 16*a* to be driven is advanced into the guide tube 75. In this regard as shown in FIG. 3, the user's thumb has engaged the pressure plate 61 and urged the pressure plate 61 to rotate the lever 48 counterclockwise and thus move the first end 49 of the lever 48 to an advanced position advancing the shuttle 96 forward to the advanced position and thus urging with the pawl 99 the next screw 16*a* to be driven into the guide tube 75 into axial alignment with the driver shaft 34 as, for example, also illustrated in FIG. 8.

As shown, in the lever 48 pivoting from the withdrawn position of FIG. 2 to the advanced position of FIG. 3, the lost motion slot 54 compensates to translate the angular movement of the lever 48 into linear movement of the shuttle 96.

As seen in FIG. 3, the first, lead screw 16*a* has been advanced to a position in which the screw is axially in line with the driver shaft 34. The same position is effectively shown in cross-section in FIG. 8, however, from the opposite side to that shown in FIG. 3 and without the rear portion 22 or the hand of the user being shown. In the position in FIG. 3, it is to be appreciated that the other hand of the user is holding the power driver 11 manually in a position such that the bit of the driver shaft 34 is rearward of the heads of the screws. From the position shown in FIG. 3, a user manually urges the power driver 11 and the driver shaft 34 downwardly so as to engage the head of the lead screw 16*a* with the bit becoming received in the recess in the head of this screw. On rotation of the screw downwardly, this screw is disengaged from the plastic strip 13 and, subsequently, driven down fully into a workpiece as shown in FIG. 4.

It is to be appreciated that on the screw head being driven downwardly from the position of FIG. 3 to the position of FIG. 4 that the screw head must pass by the pawl 99. Preferably, as the screw head engages the pawl 99 or before the screw head engages the pawl 99, the pressure of the user's thumb on the pressure plate 61 will be released so that the pawl will withdraw under the bias of the return spring 308 at least out from under the path of the head of the screw being driven. In one sense, when driving the screw downwardly, the user will feel the engagement of the head of the screw on the pawl 99 as translated to a pressure on a pressure plate 61 and this will be a signal for the user to release the pressure plate 61. Alternatively, on the driver shaft 34 being urged downwardly at a distance to sufficiently become engaged in the head of the screw, the user may then release the pressure plate 61 with the thumb and the return spring 308 will then move the shuttle 96 and its pawl 99 to a withdrawn position out of the way of the head of the screw and to the position of the shuttle and pawl shown in FIG. 2 ready to advance the next screw. FIG. 9 shows the lead screw 16*a* being driven by the driver shaft 34 and with the shuttle 96 and its pawl 99 having been withdrawn to the withdrawn position. FIG. 9 effectively can comprise a possible configuration intermediate the positions shown in FIGS. 3 and 4 however, with the pressure plate 61 having been released.

The pawl 99 can be configured so that, in the event a user may maintain some pressure on the pressure plate 61 while the screw is being driven from the position of FIG. 3 past the pawl, the pawl will, to some extent, automatically be urged or cammed towards the withdrawn position by engagement with the under surfaces of the head of the screw.

A visual indicator can be provided to the user, for example, as a release indicator 310 on the driver shaft 34 such that on the driver shaft 34 being moved into the slide body 18, when the release indicator 310 reaches the rear 282 of the rear portion 22, the user will then appreciate that it is appropriate to release the thumb pressure on the pressure plate 61, i.e., at a time when the driver shaft bit will have engaged into the head of the screw yet prior to the time when the head of the screw may engage the pawl 99.

From the position shown in FIG. 4, on release of the pressure plate 61 by the thumb, it is to be appreciated that the return spring 308 will return the lever 48 to the withdrawn position and the device will reassume the orientation shown in FIG. 2 ready for advance of the next screw to be driven.

The preferred embodiment shows the pawl 99 as engaging the next screw 16*a* to be driven. It is to be appreciated that the tool could be readily adapted such that the pawl 99 engages not the next screw 16*a* which is to be driven but rather the screw 16*b*, as shown in FIG. 2, adjacent the next screw to be driven. In so doing, there would be no difficulty with maintaining pressure on the pressure plate 61 as in FIG. 4 throughout the time when the screw 16*a* is being driven because there will be no interference between the pawl and the head of the screw 16*a* or the driver bit.

In accordance with one aspect of the present invention, a suitable one way anti-drawback mechanism may be provided independent of the advance pawl 99 which permits merely feeding of the screwstrip and the screws forwardly in the advance direction towards the axis 52 and which resists or prevents, preferably, unless deactivated, movement of the screwstrip in a withdrawal direction, that is, away from the direction of advance.

Figure 10:
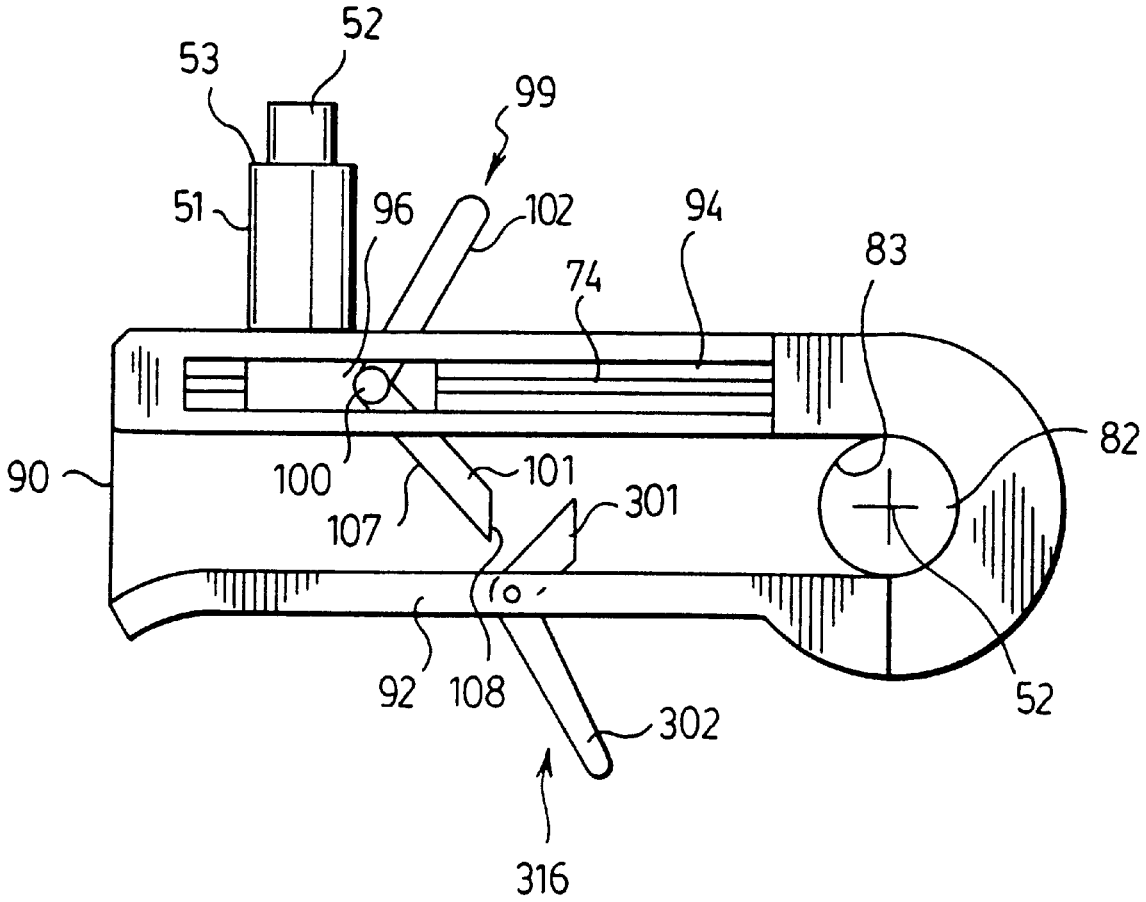
FIG. 10 is an end view of the nose portion similar to FIG. 7 but showing a second pawl.

Such one-way mechanisms can, for example, comprise as shown in FIG. 10, a simple, secondary pawl 316 which is substantially the same as the first pawl 99, however, is mounted fixed to the feed guide channel element 76 and is adapted preferably to engage the second screw 16*b* to be driven. The second pawl may likewise, like the first pawl 99, have a pawl arm 301 and a release arm 302 with the pawl biased by a torsional spring which biases the pawl arm 301 counter-clockwise into the screwstrip 14 and with pivoting of the second pawl counter-clockwise limited to the position shown in FIG. 10. A screwstrip may be advanced forwardly to the right past pawl arm 301 with the pawl arm 301 pivoting against the bias of its spring out of the way of the screws. Once a screw 16*b* has moved past pawl arm 301, the pawl arm 301 prevents withdrawal of the screw 16*b* unless the release arm 302 is manually engaged to pivot the pawl arm 301 out of the way.

The screw feed advance mechanism carried on the nose portion 24 has been illustrated merely as a reciprocally slidable shuttle carrying a pawl. Various other shuttle configurations may be adopted with the shuttle moving along a pre-set pathway which, preferably, is straight but may be curved. For example, the shuttle could be supported for sliding along a pathway being an arc in a plane parallel to a plane including the lever 48 and, for example, described by the end 49 of the lever 48. While provision of a shuttle is preferred, it is not necessary and the pawl to engage the screwstrip could be carried on the first end of the lever 48.

The nose portion 24 is removable from the rear portion 22. The nose portion 24 and the rear portion 22 may be coupled together by axially inserting the cylindrical portion 77 of the guide tube 75 into the bore 78 in the rear portion 22 with the key 80 aligned with the key way slot 81. The lever 48 may be coupled and uncoupled to the shuttle by screw 55.

The nose portion 24 carries the guide tube 75 with its screw locating guideway 82, the screw feed channel element 76 with its channelway 88, and screw feed advance mechanism with the reciprocating shuttle 96 and pawl 99 to advance the screwstrip 14 by the channelway 88 into the guideway 82. Each of the guideway 82, channel 88 and shuttle 86 are preferably customized for screwstrips and screws or other fasteners of a corresponding size. In this context, size includes shape, head diameter, shaft diameter, retaining strip configuration, length, spacing of screws along the retaining strip and the presence or absence of washers amongst others things. Different nose portions 24 are to be configured for different screwstrips and screws. The different nose configurations 24 are each compatible with the same rear portion 22 and are readily exchangeable so as to permit the driver attachment to be readily adapted to drive different screws and screwstrips.

While the illustrated embodiments shows the slide body 18 is formed with a removable nose portion, this is not necessary and to provide a less expensive device, the nose portion 24 and rear portion 22 need not be separate but may be formed integrally as from the same material as, for example, by being injection molded out of high strength plastic or nylon brand materials.

FIGS. 1 to 4 show the driver shaft 34 as comprising merely an elongate single piece shaft having a bit permanently secured to its end. FIGS. 8 and 9 show a slightly modified embodiment over that shown in FIGS. 1 to 4. In this regard, FIGS. 8 and 9 differ from FIGS. 1 to 4, firstly, with the driver shaft 34 shown as having a removable bit 122 and, secondly, with the driver shaft 34 shown as carrying an extension spring 38.

As seen in FIGS. 8 and 9, the driver shaft 34 is provided with a removable bit 122 at its forward end which bit can readily be removed for replacement by another bit as for different size screws. Such bits include sockets and the like and any replacement bit will preferably be of an outside diameter complementary to the inside diameter of guideway 82 in the corresponding replacement nose portion adapted for use with correspondingly sized screws. The replacement bit may preferably be received in a socket in a manner as described in U.S. Pat. No. 5,531,143 to Habermehl et al. issued Jul. 2, 1996.

FIGS. 8 and 9 show an extension spring 38 which is unnecessary but can be an advantageous feature. The rear portion 22 is shown in FIGS. 8 and 9 as having a radially inwardly extending annular flange 19 which provides the end of the forwardly opening bore 78 as well as the end of a rearwardly opening bore 79 in which the forward end of the spring 38 is received. The annular flange 19 has an opening therethrough of a diameter slightly larger than a diameter of the driver shaft 34 so as to assist in journaling the driver shaft therein. The opening through the annular flange 19 may however be of increased axial length so as to increase the extent to which the driver is journaled within the rear portion 22. It is to be appreciated, for example, that if in the embodiment illustrated in cross-section of FIG. 8 the spring 38 were not provided, then the entirety of the central bore in the rear portion 22 rearward of the annular flange 19 could be provided to be of a diameter which over this entire length would provide for journaling of the driver shaft 34.

The driver shaft 34 is shown in FIGS. 8 and 9 as being provided with a removable spring clip 270 which assists in locating a bearing member 272 on the driver shaft between the clip and a rearwardly directed shoulder on the driver shaft. The bearing member 272 is provided to rotate freely relative to the clip 270 and the driver shaft 34. The bearing member 272 is shown as having at its rear end a circular radially outwardly extending flange which extends outwardly beyond the coils of the spring 38 to provide a rear surface to receive the rear end of the spring. The bearing member 272 also has an axially extending cylindrical portion 272 which extends inside the spring 38 and assists in preventing the spring from binding upon the rotating driver shaft 34. As shown in FIG. 9, on driving a screw downwardly into a workpiece, the extension spring 38 is compressed and comes to assume a compressed condition within the rearwardly opening bore 79. The extension spring 38 is preferably a relatively light weight spring so that it does not require substantial forces to manually compress the spring to drive a screw. However, the spring is of some assistance to assist in withdrawing the driver shaft 34 rearwardly and providing a pressure sensitive indicator to a person manually holding the power driver 11 as to when the driver shaft 34 is withdrawn rearwardly beyond the heads of the screws 16 to be advanced. In this regard, the spring 38 will urge the driver shaft 34 rearwardly until such time as the bit 122 of the driver shaft is rearwardly of the heads of the screws to be advanced. A user will appreciate the point at which there is no resistance being offered from the spring.

It is within the scope of the present invention to provide other indication mechanisms which will permit the user to appreciate when the bit 122 on the driver shaft 34 has been withdrawn sufficiently rearward of the screws and to permit the next screw to be advanced. In the embodiments shown in FIGS. 1 to 4, the driver shaft may preferably be provided with some visual withdrawn indicator on the driver shaft 34 as indicated as 280 such that a user will appreciate that the withdrawn indicator 280 should be withdrawn rearward of the rear end 282 of the rear portion 22 before the next screw should be advanced. In this regard, the withdrawn indicator 280 could be demarked by cutting an annular groove in the driver shaft. More preferably, the colour band could be provided at this point. Preferably, the driver shaft could be coloured in a different, contrasting colour to indicate withdrawn indicator 280, for example, as by providing colour changes at withdrawn indicator 280 and release indicator 310.

As seen in FIGS. 1 and 2, the shuttle pivot pin 152 is disposed about an axis which is parallel to the pivot axle 47 about which the lever 48 pivots. Both these axis are perpendicular to the axis 52 of the driver shaft 34.

The handle portion on the rear portion 22 is adapted to permit the attachment to fit closely within the palm of a user. This is of assistance in coordinating the manual sliding of the driver shaft 34 carried by the power tool in a reciprocal motion axially within a central bore 82 of the tool 12. Provision of a spring such as spring 38 in FIGS. 8 and 9 is generally unnecessary and avoiding the use of a spring such as spring 38 reduces the forces which must be overcome in driving a screw.

Figure 11:
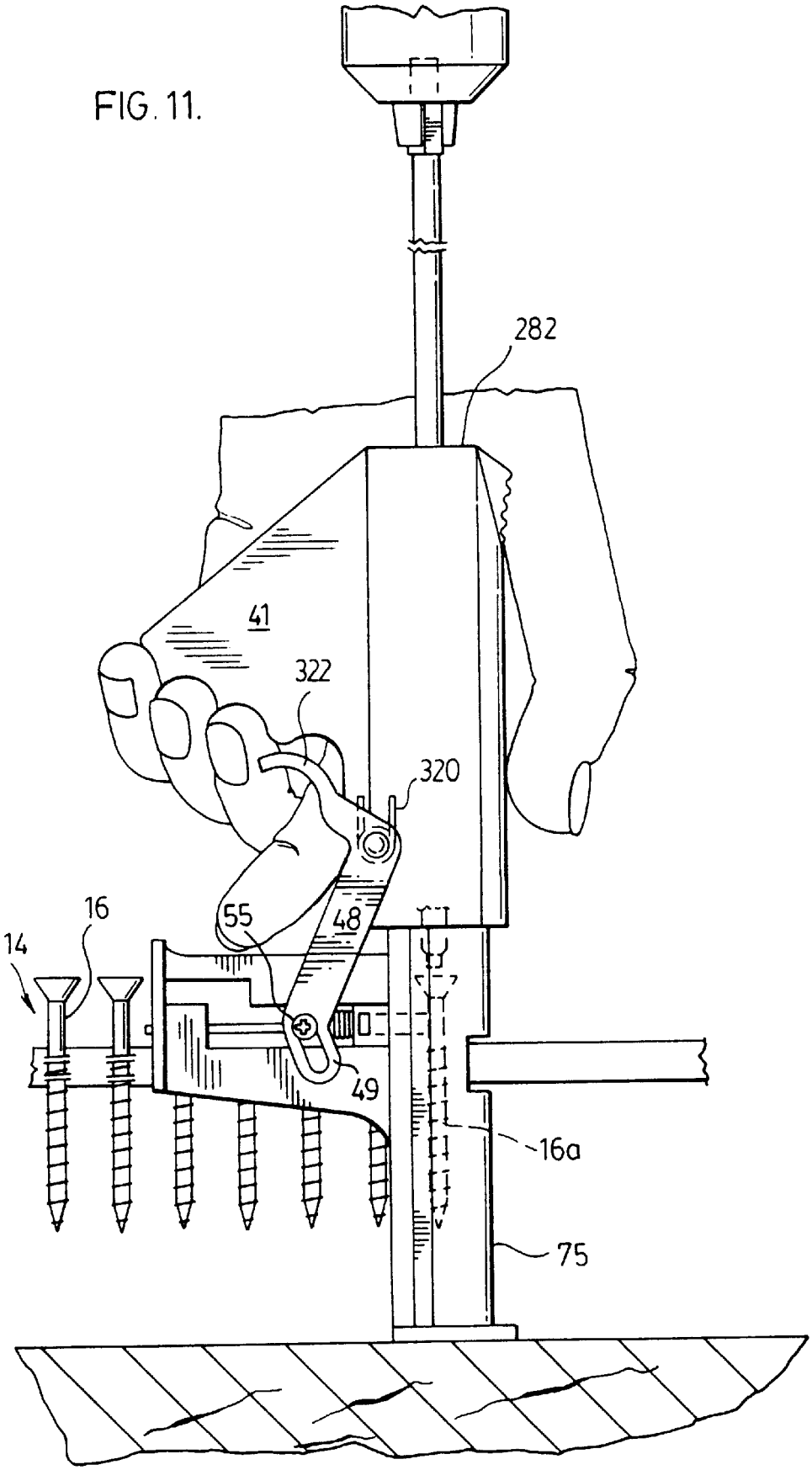
FIG. 11 is a side view similar to that shown in FIG. 3, however, of a modified second embodiment of the present invention.

The embodiments illustrated in FIGS. 1 to 9 provide a construction in which the return spring 308 biases the lever 48 to return to the withdrawn position and the lever is moved manually from the withdrawal position to the advanced position. It is within the scope of the present invention to utilize an attachment as shown in FIG. 11 in which an advance spring 320 biases the lever 48 and, therefore, the shuttle 96 and its pawl 99 to the advanced position and the lever is moved manually from the advanced position to the withdrawal position. Preferably, such a spring 320 would provide sufficient forces by itself to advance a screwstrip. As shown in FIG. 11, rather than having a thumb activated pressure plate, an index finger pressure plate is provided as a trigger 322 which is adapted such that the index finger may engage the trigger 322 and draw it rearwardly to rotate the lever 48 clockwise to a withdrawn position from the advanced position shown in FIG. 10.

Figure 12:
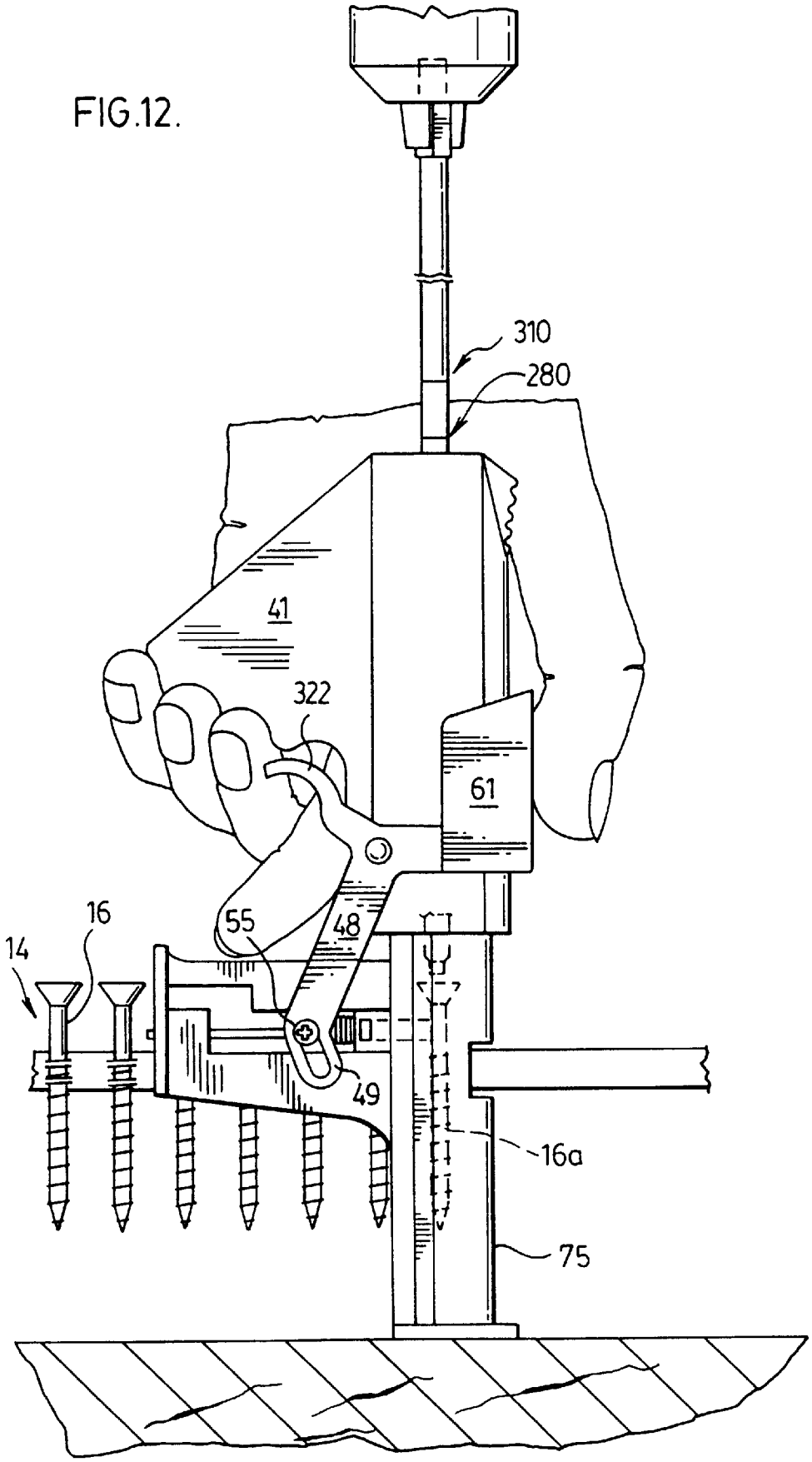
FIG. 12 is a side view similar to that shown in FIG. 3, however, of a third embodiment of the present invention.

FIG. 1 shows an arrangement with a pressure plate 61 for engagement by a user's thumb to pivot lever 48 to advance the screwstrip. FIG. 11 shows an arrangement with a trigger 322 for engagement by a user's index finger to pivot lever 48 to a withdrawn position. FIG. 12 shows an embodiment with both pressure plate 61 and trigger 322 provided on the lever 48 to provide in combination for pivoting of the lever 48 manually both for advance and withdrawal. In such a combination, springs 308 and 320 could both be eliminated, however, to maintain one or the other of springs 308 and 320 is preferred, with manually applied forces being available to assist whichever spring is provided, if necessary.

The rear portion 22 is provided with a relatively simple structure providing for ease of gripping by user's hand. It is to be appreciated that a more substantial handle structure could be provided. For example, FIG. 11 shows the digit grip portion 41 as enlarged for improved engagement by the fingers. Other structures for enhanced gripping could be provided.

The rear portion 22 could be provided at its rear 282 with various flanges and/or a conical funnel-shaped recess leading into the central bore 82 of the rear portion 22 which conical flanges or recesses may provide a form of hand guard to keep the rotating chuck distant from the hand holding the tool 12 or to provide a depth setting mechanism.

As one embodiment of the invention it can be advantageous to provide the driver shaft 34 to be longer than is necessary to completely seat a screw such that on final seating of the screw on a workpiece, the tool 12 may be lifted manually up off the workpiece to permit the operator to directly view the head of the screw 16 that has been driven. Of course, this may be unnecessary because, to some extent, the operator can view the screw 16 being driven through the slot 86 which opens in one side into the guide tube 75.

Figure 13:
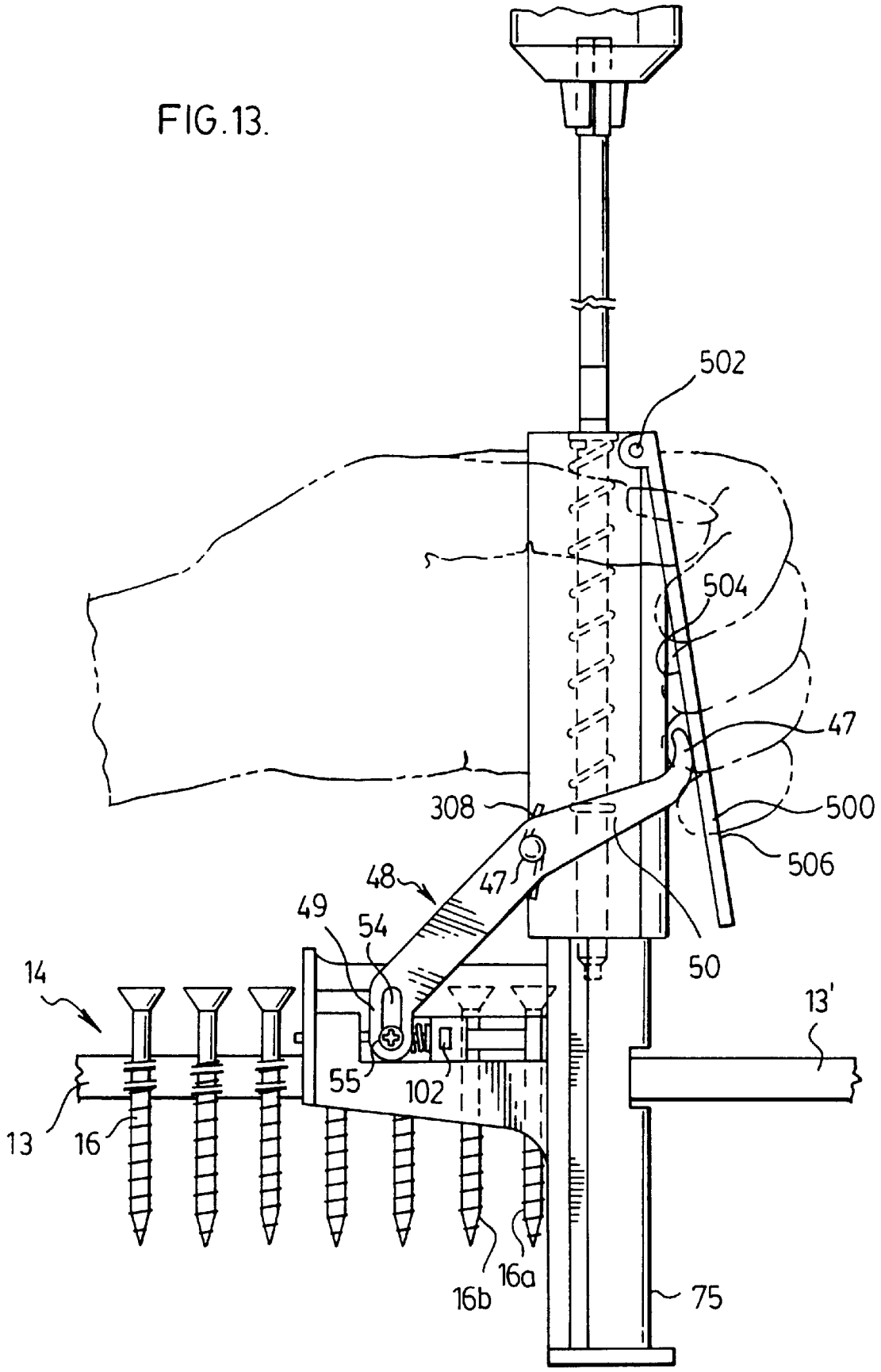
FIG. 13 is a side view similar to that shown in FIG. 3, however, of a fourth embodiment of the present invention.

FIG. 13 illustrates a fourth embodiment of the present invention which is a modification of FIG. 3 to replace the pressure plate 61 on the lever 48 by a separate lever activation member 500 which comprises a lever pivotably mounted to the slide body 18 for pivoting about axis 502 parallel the pivot pin 47 for lever 48. Activation member 500 has an inner surface 504 which engages second end 47 of the lever 48 and pivots the lever counter-clockwise to advance the shuttle 96 when the activation member 500 is pivoted clockwise. As shown, the rear portion 22 is provided as a handle to be encircled by a user's hand with the fingers to extend over an outer surface 506 of the activation member 500 and by squeezing the handle, pivot the activation member 500 clockwise. A return spring 308 preferably biases the lever 48 to pivot clockwise.

Figure 14:
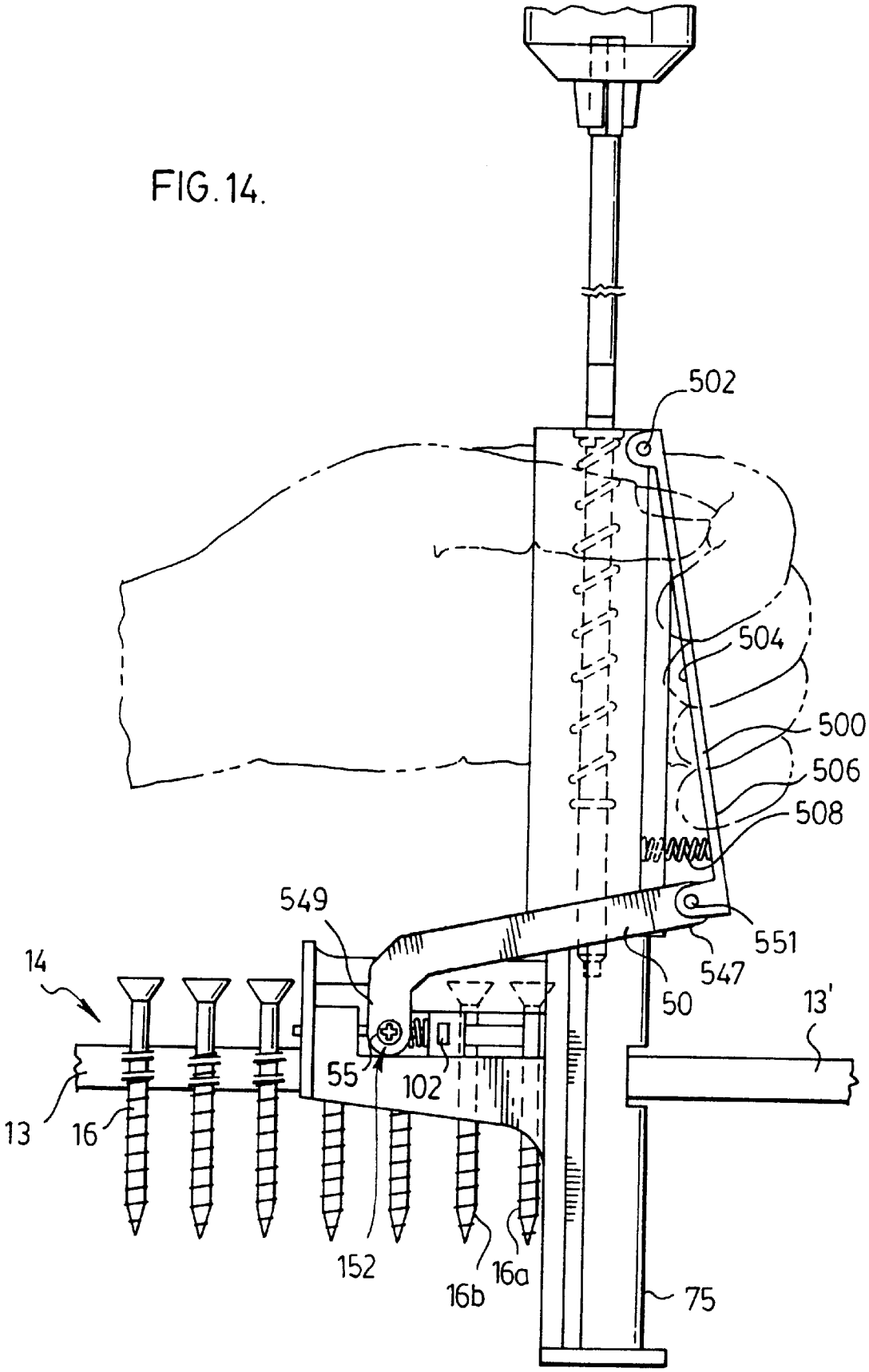
FIG. 14 is a side view similar to that shown in FIG. 13 of a fifth embodiment of the present invention.

FIG. 14 illustrates a fifth embodiment of the present invention which is a modification of FIG. 13 to replace lever 48 by a linkage member 548 pivotably connected at both its ends 549 and 547 to the shuttle 96 and the activation member 500 for pivoting about pin 152 on the shuttle and axis 551 both parallel the axis 502. The activation member 500 serves as a primary lever member which is pivotably coupled to the slide body 18. A spring 508 biases activation member 500 to pivot counter-clockwise, however, other springs could be provided to pivot the activation member 500 clockwise.

FIGS. 13 and 14 illustrate a hand grip configuration in which the hand is about the slide body 18 as in the manner that a chisel may normally be held.

Figure 15:
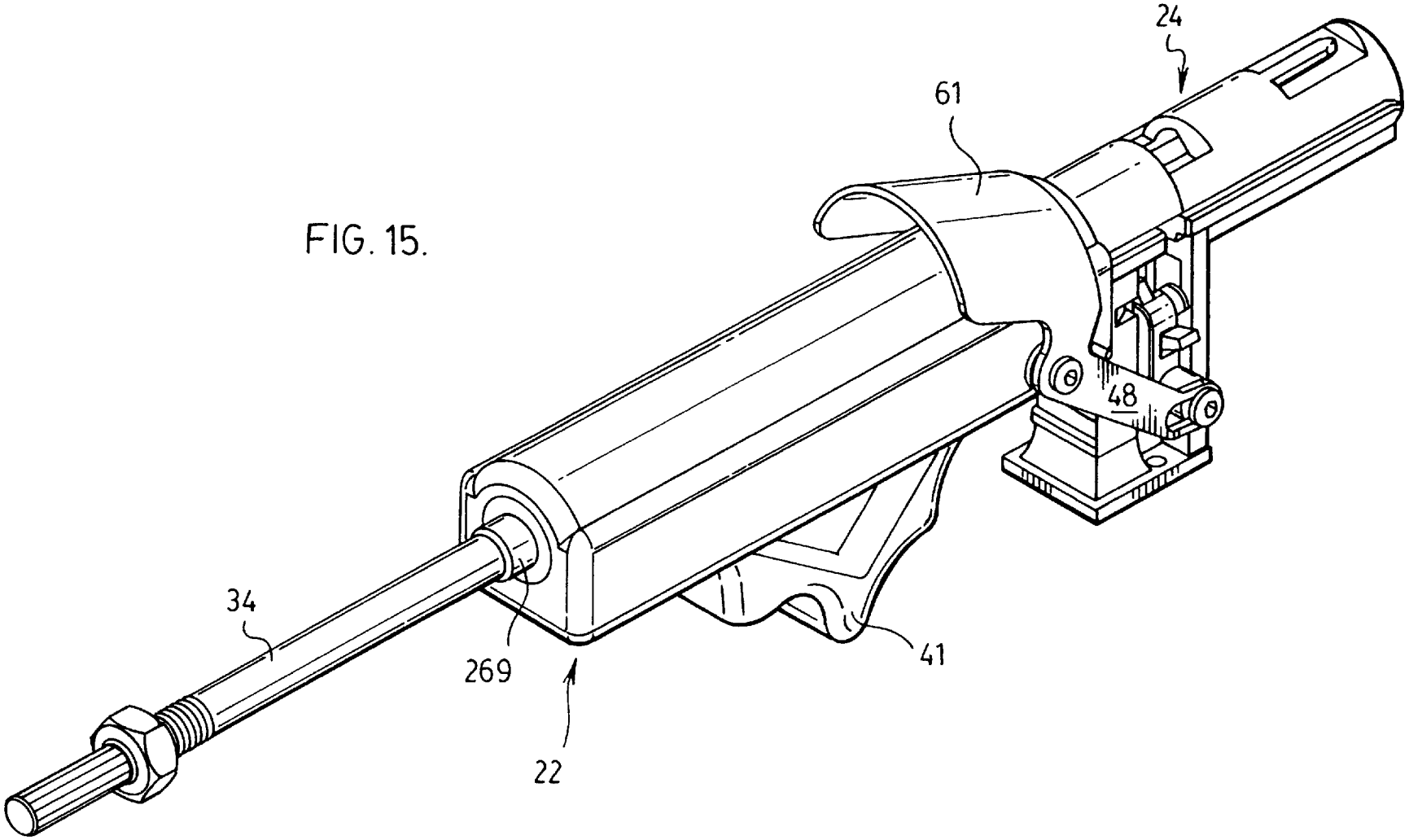
FIG. 15 is a pictorial view of a sixth embodiment of the present invention.
Figure 16:
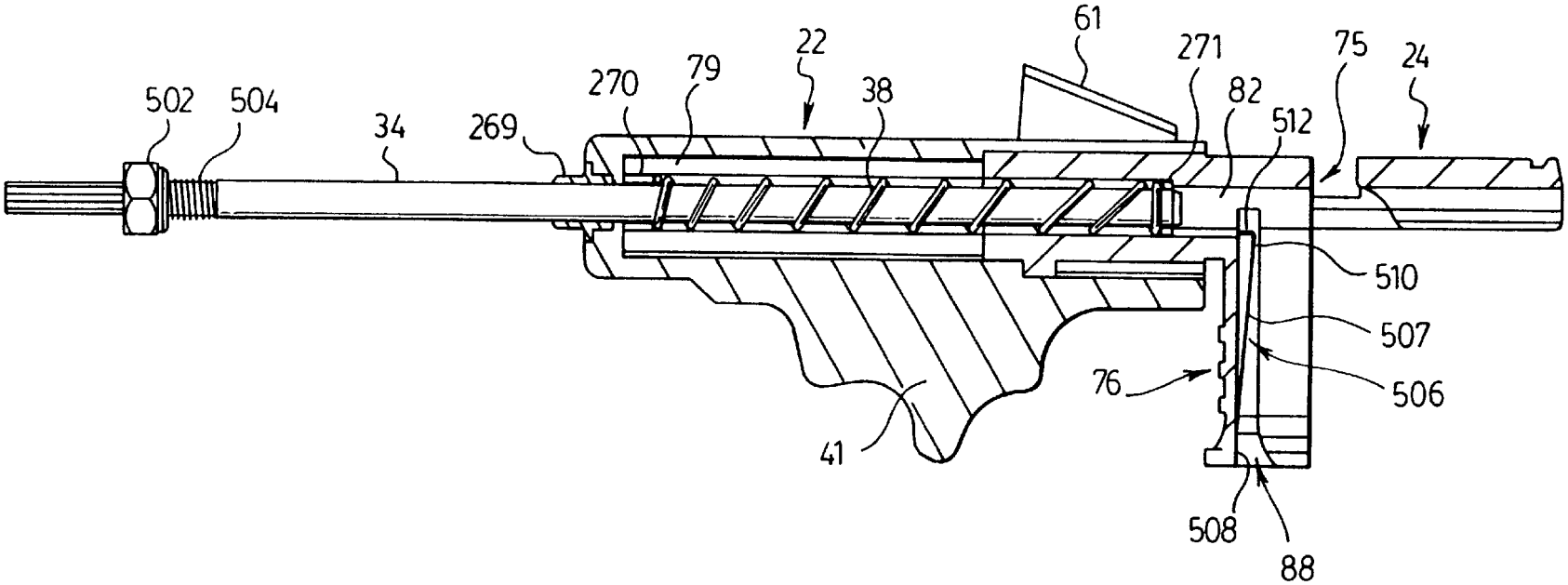
FIG. 16 is a schematic cross sectional view of the embodiment of FIG. 15 in an extended position.
Figure 17:
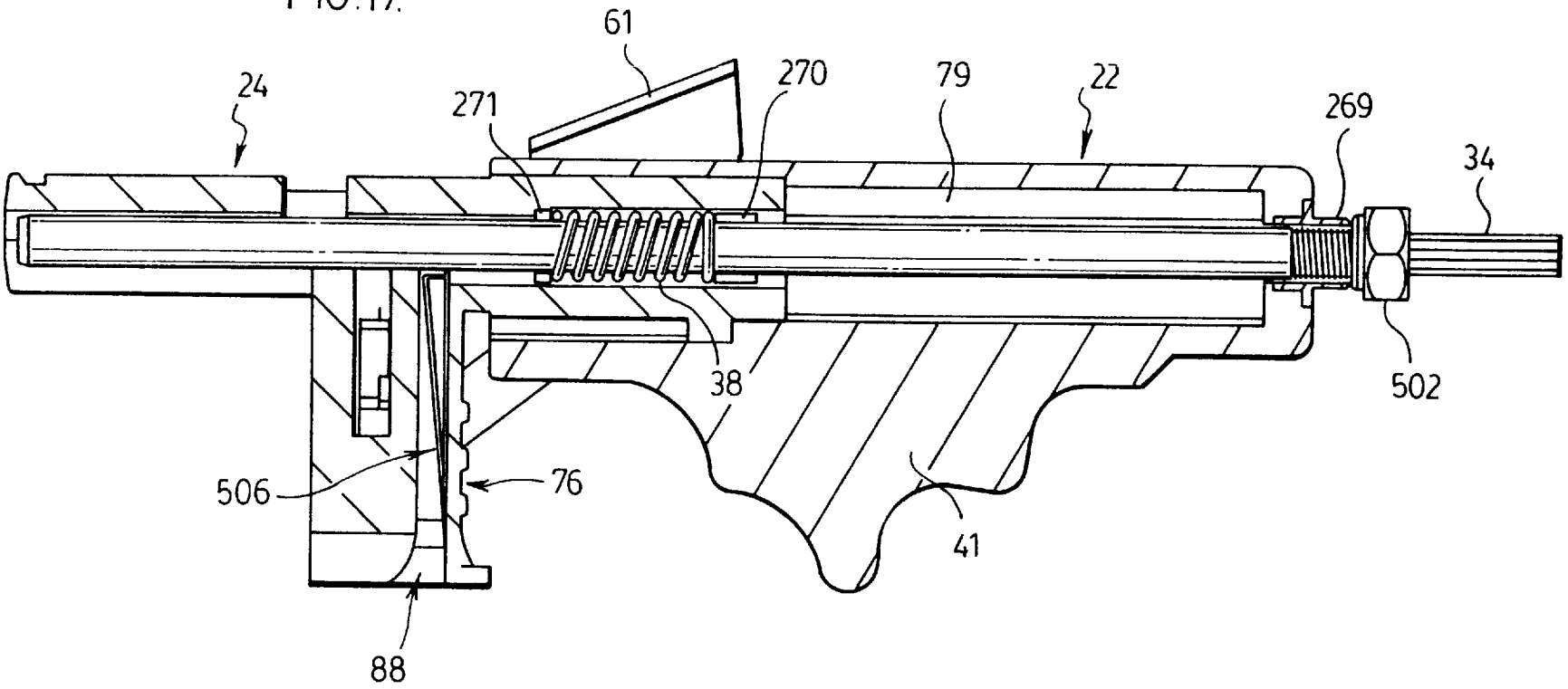
FIG. 17 is a schematic cross sectional view similar to FIG. 16 but from the other side and showing a retracted position.

FIGS. 15, 16 and 17 show a sixth embodiment of the tool of the present invention, having features similar to those illustrated with the first embodiment and for which similar reference numerals refer to equivalent elements.

As best shown in FIG. 16, the rear bore 79 in rear portion 22 encloses the spring 38. The spring is trapped in the bore 79 between a bushing 270 secured to the driver shaft 34 and a first rear bushing 271 which is free to rotate with the shaft 34. The bore 79 is closed at its rear by a rear wear bushing 269.

A depth adjustment mechanism is provided as a friction nut 502 received on a threaded section 504 of shaft 34, with the nut 502 to engage the rear of the rear wear bushing 269 as shown in FIG. 17 to limit retraction and hence the depth screws may be driven.

FIGS. 16 and 17 schematically show an alternate form of an anti-drawback mechanism to assist in preventing a screwstrip from being moved in a withdrawal direction. The anti-drawback mechanism comprises a leaf spring 506 which is secured in the channelway 88 of the feed channel member 76. The leaf spring has a first leg 507 with a first end 508 and a second end 510. First end 508 of the leg 507 of the leaf spring is secured to the rear surface of the channelway 88. The leg 507 of the leaf spring extends from end 508 towards the guide tube 75 and is cantilevered and biased such that its second end 510 is urged forwardly for frictional engagement with the rearwardly directed, upper surfaces of the heads of the screws 16 (not shown) when the screws are received in the channelway 88 as shown in FIG. 9. By reason of this downward frictional pressure applied by leg 507, screws in a screwstrip while in the channelway 88 are frictionally held against withdrawal as when the shuttle moves to the withdrawn position. The leaf spring 506 has a rearwardly extending flange 512 at its second end 510 which assists in retaining within the guide tube 75, the last screw on strip. A last screw may be advanced into the guideway 82 past the flange 512. The flange 512 will then be moved with the leg 507 forwardly to be located radially to the side of the head of the last screw thus blocking the last screw from withdrawal. Only when there are no screws in the channelway 88 can the leaf spring move forwardly to physically block removal of the last screw then in the guideway 82. The flange 512 extends rearwardly into a receiving slot in the guide tube 75 to permit rearward movement of first leg 507 of the leaf spring to a position in which it is substantially be pressed fully upward into the rear surface of the channelway 88.

The feed tool 12 may be constructed from different materials of construction having regard to characteristics of wear and the intended use of the tool. Preferably, the entirety or a number of the parts may be molded from nylon or other suitably strong lightweight materials. Parts which are subjected to a successive wear as by engagement by the head of the screw may be formed from metal or, alternatively, metal inserts may be provided with an injected molded plastic or nylon part. The provision of a removable nose portion has the advantage of permitting the removable nose to be provided with surfaces which would bear the greatest loading and wear in which nose portions may be easily replaced when worn.

In a preferred embodiment, the screwstrip 14 is illustrated as having screws extending normal to the longitudinal extension of the strip 13 and, in this context, the channelway 88 is disposed normal to the longitudinal axis 52. It is to be appreciated that screws and other fasteners may be collated on a screwstrip in parallel spaced relation.

A preferred collated screwstrip 14 for use in accordance with the present invention is as illustrated in the drawings and particularly FIG. 5 and, preferably, are substantial in accordance with U.S. Pat. No. 5,758,768 to Habermehl et al, issued Jun. 2, 1998. The screwstrips 14 comprise a retaining strip 13 and a plurality of screws. The retaining strip 13 comprises an elongate thin band formed of a plurality of identical sleeves interconnected by lands 106. A screw 16 is received within each sleeve. Each screw 16 has a head 17, a shank 208 carrying external threads 214 and a tip 15. As shown, the external threads extend from below the head 17 to the tip 15. Each screw is substantially symmetrical about a central longitudinal axis 212. The head has at its top surface a recess 213 for engagement by the screwdriver bit.

Each screw is received with its threaded shank 208 engaged within a sleeve. In forming the sleeves about the screw, the exterior surfaces of the sleeve come to be formed with complimentary threaded portions which engage the external thread 214 of the screw 16. Each sleeve has a reduced portion between the lands 106 on one first side of the strip. This reduced strength portion is shown where the strip extends about each screw merely as thin strap-like portions or strap 220, one or more of which may be provided.

The strip 13 holds the screw 16 in parallel spaced relation a uniform distance apart. The strip 13 has a forward surface 222 and a rear surface 223. The lands 106 extend both between screws 16, that is, horizontally as seen in FIG. 5 and axially of the screw 16, that is, in the direction of the longitudinal axis 212 of the screws. Thus, the lands comprise webs of plastic material provided over an area extending between sleeves holding the screws and between the forward surface 222 and the rear surface 223. A land 106 effectively is disposed about a plane which is parallel about a plane which is parallel to a plane in which the axes 212 of all the screws lie. Thus, lands 106 comprise a web which is disposed substantially vertically compared to the vertically oriented screws, as shown in the figures. The lands 106 and the sleeves, in effect, are disposed as continuous, vertically disposed strip 13 along the rear of the screw 16, that is, as a strip 13 which is substantially disposed about a plane which is parallel to a plane containing the axes of the screws.

The screwstrips preferably are screwstrips of a discrete length such as 6 to 18 inches length.

The invention is not limited to use with the collated screwstrips illustrated. Many other forms of screwstrips may be used with suitably arranged semiautomatic tools of the present invention. Other forms of screwstrips include those illustrated in U.S. Pat. No. 3,910,324 to Nasiatka; U.S. Pat. No. 5,083,483 to Takaji; U.S. Pat. No. 4,019,631 to Leidegard et al and U.S. Pat. No. 4,018,254 to DeCaro.

While the invention has been described with reference to the preferred embodiments, the invention is not so limited. Many variations and modifications will now occur to persons skilled in the art. For a definition of the invention, reference is made to the appended claims.

We claim:

1. An apparatus for driving with a power driver a screwstrip comprising threaded fasteners, such as screws or the like, which are joined together in a strip comprising:

an elongated driver shaft having a rear end for operative connection to a power driver for rotation therewith and a forward end carrying a fastener engaging member, the driver shaft defining a longitudinal axis;

a slide body about the driver shaft for displacement parallel to the axis of the driver shaft, the slide body having a guide channel for said screwstrip transverse to the axis, a pawl member carried by the slide body movable relative to slide body transverse to the axis towards and away from the axis between an advanced position and a withdrawn position, the advanced position being closer to the axis than the withdrawn position, the pawl member adapted for engagement with the screwstrip to advance the screwstrip in the guide channel with movement of the pawl member towards the axis to the advanced position to place each successive first of the fasteners into axial alignment with the driver shaft for driving by the driver shaft, the pawl member adapted for movement away from the axis to the withdrawn position ready for subsequent movement toward the axis to advance a next successive first of the fasteners, a lever having a first end and a second end, the lever pivotally mounted to the slide body intermediate the first end of the lever and the second end of the lever;

the first end of the lever coupled to the pawl member whereby movement of the second end of the lever in a first direction moves the pawl member towards the advanced position and movement of the second end of the lever in a second direction opposite the first direction moves the pawl member toward the withdrawn position;

the slide body having a handle portion adapted for manual grasping for a hand of a user, the second end of the lever disposed proximate the handle portion adapted for releasable engagement by a user's hand grasping the handle to pivot the lever in the first direction, a spring biasing the pawl member away from the axis for movement toward the withdrawn position.

2. An apparatus is claimed in claim 1 including a one-way mechanism engaging the screwstrip and preventing movement of the screwstrip in the guide channel in a direction opposite to the direction for advance.

3. An apparatus is claimed in claim 1 including a one-way mechanism engaging the screwstrip and preventing movement of the screwstrip in the guide channel in a direction opposite to the direction for advance when the pawl member withdraws from the advanced position to the withdrawn position.

4. An apparatus as claimed in claim 2 wherein said one-way mechanism engages the screw next to a screw to be driven.

5. An apparatus as claimed in claim 1 wherein said handle portion is disposed rearward of the guide channel.

6. An apparatus as claimed in claim 1 wherein said slide body has a central bore axially therethrough for receipt of the driver shaft and for journalling the slide body relative the driver shaft for relative axial sliding parallel the axis.

7. An apparatus as claimed in claim 6 wherein the slide body comprises a generally elongate body portion disposed about the central bore, a screwstrip guide member extending radially from one side of the body portion, the guide channel disposed within the guide member to extend therethrough and open radially into the bore, the pawl member slidably carried on the guide member for movement towards and away from the axis parallel the guide channel.

8. An apparatus as claimed in claim 7 wherein the pawl member is slidably mounted for movement along a linear path parallel the guide channel, the lever is pivotally mounted to the slide body for rotation about a lever pivot axis perpendicular to the axis and perpendicular to the linear path.

9. An apparatus as claimed in claim 7 wherein a shuttle member is mounted on the guide member for movement towards and away from the axis parallel the guide channel, the pawl member is carried by the shuttle member, and the first end of the lever is coupled to the shuttle member.

10. An apparatus as claimed in claim 9 wherein the pawl member comprises an elongate member pivotally mounted to the shuttle member and having a pawl end which engages the screwstrip to advance the screwstrip when the shuttle member is moved in an advance direction and wherein, when the shuttle member is moved in a direction opposite the advance direction, the pawl end of the pawl member pivots against the bias of the pawl spring out of the way of the screwstrip to permit the pawl member to be moved away from the axis to the withdrawal position past the screwstrip.

11. An apparatus as claimed in claim 10 wherein the shuttle member is mounted to the guide member for movement along a linear path parallel the guide channel, the shuttle member carrying a shuttle post extending parallel the lever post axis, the first end of the lever carrying a lost motion slot, the shuttle post received in the lost motion slot whereby pivoting movement of the first end of the lever moves the shuttle member parallel the guide channel.

12. An apparatus as claimed in claim 7 wherein the guide member extends radially from the body portion on a first side thereof, the second end of the lever extends from a second side of the body portion opposite the first side, the handle portion including a digit grip extension member extending radially from the body portion on the first side thereof extending generally radially away from the body portion parallel the guide member and spaced rearwardly from the guide member, the digit grip portion adapted for engagement by the fingers of a user's hand, the handle portion including a thumb grip portion provided on the body portion on the second side of the body portion adapted for engagement by the thumb of the user's hand while the fingers of the user's hand engage the digit grip portion, the second end of the lever located proximate the thumb grip portion and adapted for releasable engagement by the thumb of a user's hand.

13. An apparatus as claimed in claim 1 wherein with the pawl maintained in the advanced position, the screwstrip is held against movement in a direction away from the axis.

14. An apparatus for driving with a power driver a screwstrip comprising threaded fasteners, such as screws or the like, which are joined together in a strip comprising:

an elongated driver shaft having a rear end for operative connection to a power driver for rotation therewith and a forward end carrying a fastener engaging member, the driver shaft defining a longitudinal axis;

a slide body about the driver shaft for displacement parallel to the axis of the driver shaft, the slide body having a guide channel for said screwstrip transverse to the axis, a pawl member carried by the slide body movable relative to slide body transverse to the axis towards and away from the axis between an advanced position and a withdrawn position, the advanced position being closer to the axis than the withdrawn position, the pawl member adapted for engagement with the screwstrip to advance the screwstrip in the guide channel with movement of the pawl member towards the axis to the advanced position to place each successive first of the fasteners into axial alignment with the driver shaft for driving by the driver shaft, the pawl member adapted for movement away from the axis to the withdrawn position ready for subsequent movement toward the axis to advance a next successive first of the fasteners, a lever having a first end, the lever pivotally mounted to the slide body remote from the first end;

the first end of the lever coupled to the pawl member whereby pivoting of the lever in a first direction moves the pawl member towards the advanced position and pivoting of the lever in a second direction opposite the first direction moves the pawl member toward the withdrawn position;

the slide body having a handle portion adapted for manual grasping for a hand of a user, the lever disposed proximate the handle portion adapted for releasable engagement by a user's hand grasping the handle to pivot the lever in at least one of the first direction and the second direction.

15. An apparatus as claimed in claim 14 including a spring biasing the lever for pivoting in one of the first direction and the second direction.

16. An apparatus for driving with a power driver a screwstrip comprising threaded fasteners, such as screws or the like, which are joined together in a strip comprising:

an elongated driver shaft having a rear end for operative connection to a power driver for rotation therewith and a forward end carrying a fastener engaging member, the driver shaft defining a longitudinal axis;

a slide body about the driver shaft for displacement parallel to the axis of the driver shaft, the slide body having a guide channel for said screwstrip transverse to the axis, a pawl member carried by the slide body movable relative to slide body transverse to the axis towards and away from the axis between an advanced position and a withdrawn position, the advanced position being closer to the axis than the withdrawn position, the pawl member adapted for engagement with the screwstrip to advance the screwstrip in the guide channel with movement of the pawl member towards the axis to the advanced position to place each successive first of the fasteners into axial alignment with the driver shaft for driving by the driver shaft, the pawl member adapted for movement away from the axis to the withdrawn position ready for subsequent movement toward the axis to advance a next successive first of the fasteners, a lever having a first end, the lever pivotally mounted to the slide body remote from the first end of the lever;

the first end of the lever coupled to the pawl member whereby pivoting of the lever in a first direction moves the pawl member towards the advanced position and pivoting of the lever in a second direction opposite the first direction moves the pawl member toward the withdrawn position;

a lever activation member coupled to the lever whereby movement of the lever activation member pivots the lever, the slide body having a handle portion adapted for manual grasping for a hand of a user, the lever activation member carried by the slide body and disposed proximate the handle portion adapted for releasable engagement by a user's hand grasping the handle to pivot the lever in at least one of the first direction and the second direction.

17. An apparatus as claimed in claim 16 including a spring biasing the lever for pivoting in one of the first direction and the second direction.

18. An apparatus is claimed in claim 16 including a one-way mechanism engaging the screwstrip and preventing movement of the screwstrip in the guide channel in a direction opposite to the direction for advance.

19. An apparatus is claimed in claim 16 including a one-way mechanism engaging the screwstrip and preventing movement of the screwstrip in the guide channel in a direction opposite to the direction for advance when the pawl member withdraws from the advanced position to the withdrawn position.

20. An apparatus as claimed in claim 16 wherein said slide body has a central bore axially therethrough for receipt of the driver shaft and for journalling the slide body relative the driver shaft for relative axial sliding parallel the axis.

* * * * *